US011644259B1

(12) United States Patent
Kennedy

(10) Patent No.: US 11,644,259 B1
(45) Date of Patent: May 9, 2023

(54) SYSTEMS AND METHODS FOR A SEGMENTED SPEED LOADER

(71) Applicant: Jordan Kristomas Kennedy, Chandler, AZ (US)

(72) Inventor: Jordan Kristomas Kennedy, Chandler, AZ (US)

( * ) Notice: Subject to any disclaimer, the term of this patent is extended or adjusted under 35 U.S.C. 154(b) by 0 days.

(21) Appl. No.: 17/536,094

(22) Filed: Nov. 28, 2021

(51) Int. Cl.
*F41A 9/85* (2006.01)

(52) U.S. Cl.
CPC ..... *F41A 9/85* (2013.01)

(58) Field of Classification Search
CPC ..... F41A 9/85
USPC ..... 42/89
See application file for complete search history.

(56) References Cited

U.S. PATENT DOCUMENTS 891,374 A 10/1907 Ruszitszka
1,137,543 A 4/1915 Sergeeff
1,231,106 A 6/1917 Wesson
1,556,255 A * 10/1925 Silva ..... F41A 9/85 42/89
1,835,517 A 12/1931 Otto
1,891,437 A 12/1932 Milmore
1,964,171 A * 6/1934 Pflaume ..... F41A 9/85 42/89
1,969,817 A 8/1934 Milmore
2,073,436 A 3/1937 Woodhead
3,057,103 A * 10/1962 Bivens ..... F41A 9/85 42/89
3,213,559 A 10/1965 Matich
3,503,150 A * 3/1970 Bye ..... F41A 9/85 42/89
3,706,260 A 12/1972 Rausing
3,785,077 A * 1/1974 Price ..... F41A 9/85 42/89
4,254,571 A 3/1981 Peter
4,325,198 A 4/1982 Muck
4,402,153 A 9/1983 Peter
4,614,053 A 9/1986 Billman
4,862,622 A 9/1989 Goyanes
(Continued)

OTHER PUBLICATIONS

What is The Best Revolver Speedloader? Accessed on Jun. 17, 2021. Accessed at https://revolverguy.com/what-is-the-best-revolver-speedloader/.

(Continued)

*Primary Examiner* — Bret Hayes
(74) *Attorney, Agent, or Firm* — Lisa Foundation Patent Law Clinic

(57) ABSTRACT

Systems and methods for loading a firearm. For example, some embodiments may include a device comprising a body defining a first segment, a second segment, and a third segment; a first pivot point engaged between the first segment and the second segment; and a second pivot point engaged between the second segment and the third segment. Each segment may comprise at least one receptacle capable of accepting a round for use in a firearm. A retainer may be in mechanical communication with each receptacle. The first segment, the second segment, and the third segment may be configured to change between an open configuration and a closed configuration. The receptacles may be configured to align and interface with the chambers of a cylinder of a firearm if the device is in the closed configuration.

11 Claims, 11 Drawing Sheets

(56) References Cited

U.S. PATENT DOCUMENTS

| | | | | |
|---|---|---|---|---|
| 5,842,299 | A * | 12/1998 | Switzer | F41A 9/85 42/88 |
| 7,363,845 | B2 | 4/2008 | McClellan | |
| 10,209,018 | B1 | 2/2019 | Yaxley | |
| D845,425 | S | 4/2019 | Yaxley | |
| 2006/0101698 | A1* | 5/2006 | Lin | F41A 9/85 42/89 |
| 2021/0199398 | A1* | 7/2021 | Woods, III | F41A 9/85 |

OTHER PUBLICATIONS

The CK Tactical Ripcord Speedloader. Accessed on Jun. 17, 2021. Accessed at https://revolverguy.com/ck-tactical-ripcord-speedloader/.

Blast from the Past: Popular Police Speedloaders of the 1970s. Accessed on Jun. 17, 2021. Accessed at https://revolverguy.com/blast-past-popular-police-speedloaders-1970s/.

* cited by examiner

SYSTEMS AND METHODS FOR A SEGMENTED SPEED LOADER

CROSS REFERENCE TO RELATED APPLICATIONS

Not applicable.

STATEMENT REGARDING FEDERALLY SPONSORED RESEARCH

Not applicable.

NAMES OF PARTIES TO A JOINT RESEARCH AGREEMENT

Not applicable.

REFERENCE TO A SEQUENCE LISTING, TABLE, OR COMPUTER PROGRAM

Not applicable.

BACKGROUND

The field of the present invention relates generally to speed reloading a revolver type firearm.

There are two main problems relating to reloading a revolver type firearm: the speed of the reload, and the carrying of the rounds and the speed loader on oneself. One type of speed loader is the circular type. The circular type allows a user to load all of the chambers of the cylinder at once; however, carrying the circular speed loader can be problematic. The circular shape makes it bulky such that it does not fit well in pockets. A belt holster is often used with the circular speed loader; however, due to its bulky size, it cannot easily be concealed. To address this problem, linear speed loaders can be used. These store the rounds in a linear line, allowing for easy concealment in one's pocket or holster. However, the linear design means that only two rounds can be loaded into the chambers of the cylinder at a time, greatly slowing down the reloading time of the revolver. There have been speed loaders developed to address this problem, by changing between a circular and linear configuration; however, those speed loaders have not had great commercial or practical success. Those transforming speed loaders have had problems with retaining the bullets in the speed loader, while the speed loader changes between the circular and linear shape. In addition, changing the speed loader between the circular and linear configuration has also been problematic, in regard to aligning the rounds to the chambers of the cylinder.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 891,374 discloses a cartridge feeding device for machine guns or the like. According to the invention, separate chain links, preferably made of metal and carrying one or more cartridges, are arranged one behind the other to form a chain like band; these chain links after passing through the feeding device, that is when they no longer contain cartridges, are disconnected each separately from the chain, two adjacent links being connected either by the cartridges themselves or be independent devices on the links themselves and in the first case the connection is released by the removal of the cartridge which is performed by the weapon itself and in the second case it is release automatically by some special means fixed to the breech.

U.S. Pat. No. 1,137,543 discloses a cartridge holder. The invention relates to a cartridge holder having a plurality of movably connected elements provided with cartridge-retaining means, and means on said holder to dispose the elements with the cartridge-retaining means in a circular series corresponding with the circular series of chambers in the magazine of a firearm.

U.S. Pat. No. 1,231,106 discloses a cartridge pack for revolvers. The invention relates to the clip or holder for the cartridges is of annular shape, being made of sheet metal occupying a plane transverse to the cartridges and engaging the bases or necks thereof, and having an annular outer portion and inner portions or fingers forming between them recesses for receiving the cartridges, and the clip being sufficiently resilient to enable the cartridges to be forced into said recesses from the center outwardly.

U.S. Pat. No. 1,835,517 discloses a cartridge magazine. The invention relates to a cartridge magazine, a housing made in hingedly interconnected sections forming a substantial cylindrical wall and a bottom with the comparatively long hinges in the wall-sections provided with a lock by which the housing can be held in the general form of a ring-like magazine and having means for holding cartridges in positions adapted to fit them equally well in the several channels of the drum of a revolver when the magazine is placed over the end of a drum in open reloading position.

U.S. Pat. No. 1,891,437 discloses a rapid revolver loader. The device consists of a flat spring which is provided with a finger grip and of a plurality of cartridge clips which are welded, soldered or otherwise suitably secured to the spring.

U.S. Pat. No. 1,969,817 discloses a rapid revolver loader. The device comprises a flat spring which is provided with a finger grip and on which two rows of cartridge clips are formed or secured in any suitable manner.

U.S. Pat. No. 2,073,436 discloses a revolver clip. The invention consists of a flexible device consisting of a series of pivoted units each provided with a clip for engagement with the shell of a bullet, the whole adapted to be disposed about the revolver in a position to substantially aline the bullets with the bullet receiving chamber of the magazine for the purpose of effecting a quick and efficient loading of the revolver.

U.S. Pat. No. 3,213,559 discloses a loading device for revolvers. The invention relates to apparatus for simultaneously loading all the chambers in a revolver cylinder with cartridges.

U.S. Pat. No. 3,706,260 discloses a cartridge belt. The invention relates to a cartridge belt for automatic firearms includes a plastic strip having transverse, spaced grooves for receiving the cartridges, the central transverse portions of the areas of the belt between the grooves being molecularly oriented to permit hinging of the belt without deformation of adjacent portions of the belt so as to improve flexibility of the belt.

U.S. Pat. No. 4,254,571 discloses a cartridge load for a revolver. The invention relates to a loading device for the rounds or cartridges of a revolver comprises a generally circular array of pockets receiving the individual cartridges and a ring which can be grasped by a finger to draw the loading device away from the cartridges. The unitary device has a closed cartridge ring, which can be injection molded around the cartridges and has the finger ring disposed at one side, is provided with at least one weakened zone. The weakened zone enables the cartridge ring to readily spread open. The pockets for the cartridges preferably open inwardly toward the axis.

U.S. Pat. No. 4,325,198 discloses a cartridge load for revolvers. The invention relates to a cartridge load for a revolver comprises a plurality of angularly spaced cartridges distributed in a circle, each having a respective casing, powder charge and bullet, with the casings being interconnected at their peripheries by thin flexible ligatures which are formed unitarily, i.e. in one piece, with the material of the casing so that the cartridges collectively form a ring which is limitedly expandable to fit into the drum or cylinder bores of different makes of revolvers.

U.S. Pat. No. 4,402,153 discloses a cartridge load for a revolver. The invention relates to a loading device for the rounds or cartridges of a revolver comprises a generally circular array of pockets receiving the individual cartridges and a ring which can be grasped by a finger to draw the loading device away from the cartridges. The unitary device has a closed cartridge ring, which can be injection molded around the cartridges and has the finger ring disposed at one side, is provided with at least one weakened zone. The weakened zone enables the cartridge ring to readily spread open. The pockets for the cartridges preferably open inwardly toward the axis.

U.S. Pat. No. 4,614,053 discloses a snap link type cartridge speed loading device. The invention relates to a loading mechanism for securing, storing and releasing rimmed or rimless cartridges into a multiple chamber firearm such as a revolver. This loader consists of a series of links each of which is shaped and proportioned so as to secure a cartridge by clipping around a partial circumference at its base. These links are joined together to provide the proper number of cartridges for a specific firearm. Once secured in the loader, the cartridges may be stored or transported in either a flat or rolled position. When rolled the cartridge links clip together at the open ends such that the axial centerlines of the cartridges correspond in radius to the centerlines of the chambers in the revolver's cylinder. Thus rolled, the cartridges may be simultaneously inserted into their respective chambers in the cylinder and the links may be pulled away to release the cartridges into the chambers, thus rapidly loading the firearm. The link shape is also designed to hold all the cartridges firmly and to insure that the first cartridge which is released from the loader will remain in a raised position to provide a pivot point for the last link's release and insure complete removal of the loader.

U.S. Pat. No. 4,862,622 discloses a link type cartridge speed loading device. The invention relates to a speed-loading mechanism for securing and releasing cartridges into a multiple chamber cylinder of a firearm comprises a plurality of links pivotally connected together. The device comprises a plurality of substantially identical intermediate links and a master link and an end link establishing opposite ends of the device. Each intermediate link has first and second disk-like portions. The first disk portion of one link is juxtaposed beneath and rotatably connected to the second disk-like portion of an adjacent link. A flat coil spring sandwiched between the juxtaposed first and second disk portions biasing the link series into a circular configuration matching the revolver chamber pattern to enable simultaneous insertion of the cartridges into the cylinder chambers. In the circular configuration, each cartridge base is supported on the associated second disk portion by means of flanges defining retaining slots for the cartridge rim with a locking detent cooperating with the slots in a locking position to captivate the rim. Upon exertion of a pulling force on the master link causing a serial hyperextension and outward rotation of the individual links from the circular configuration past the state of substantial linear alignment of the links, the respective locking detents unlock the cartridge bases from the second disk portions enabling release of the cartridges into the cylinder chambers.

U.S. Pat. No. 7,363,845 discloses a concealable speed loader for firearms and method for loading a firearm. The invention relates to a concealable speed loader for firearms includes a flexible, one-piece body having a flat open condition, a closed annular condition, two ends and a given width. The body has grasping chambers for receiving cartridges with a length substantially greater than the given width, causing part of the length of the cartridges to protrude from the body in both the open and the closed conditions. A locking latch latches the two ends of the body in the closed condition for placement above a cylinder of a firearm with the cartridges protruding into chambers of the cylinder. The locking latch has a knob to be pulled for manually removing the body and releasing the cartridges in turn as the cylinder rotates and the cartridges drop fully into the chambers of the cylinder. A method for loading a firearm is also provided.

U.S. Pat. No. 10,209,018 discloses a cartridge speed loader for use with a revolver cylinder barrel. The invention relates to a speed loader clip for supporting a plurality of cartridges in a cylindrical array, prior to being loaded into a plurality of individual chambers configured within a rotated open cylinder barrel of a revolver style firearm. A band of a solid one piece plasticized material includes individual pairs of inward projecting and arcuate grasping portions adapted for supporting individual ones of the cartridges. End support tabs extend between each of the pairs of projecting portions for preventing cartridge slide-out during loading into the cylinder barrel. End clasp portions are integrated into each of opposite ends of the band to permit the clip to be carried in a closed position with the supported cartridges so that, upon inserting the projecting tips of the clip supported cartridge into the barrel cylinder of the revolver, a tab located in proximity to a selected one of the inter-engaged end clasp portions is manipulated to open the band and to permit the cartridges to fall into the individual cylinder chambers.

U.S. Design Pat. No. D845,425 discloses an ornamental design for a speed loader for a revolver style firearm.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant(s) will amend the specification to expressly recite the essential material that is incorporated by reference as allowed by the applicable rules.

SUMMARY

The present invention provides among other things a segmented speed loader system.

In one embodiment, a device for loading a firearm can be provided. The device may include a body defining a first segment, a second segment, and a third segment. In some aspects, the first segment may comprise a first receptacle and a second receptacle, the second segment may comprise a third receptacle and a fourth receptacle, and the third segment may comprise a fifth receptacle and a sixth receptacle. Furthermore, the first receptacle may be configured to accept a first round for use in the firearm, the second receptacle may be configured to accept a second round for use in the firearm, the third receptacle may be configured to accept a third round for use in the firearm, the fourth receptacle may be configured to accept a fourth round for use in the firearm, the fifth receptacle may be configured to accept a fifth round for use in the firearm, and the sixth receptacle may be configured to accept a sixth round for use in the firearm. The device may also comprise a first pivot point engaged between the first segment and the second segment, and a second pivot point engaged between the second segment and the third segment. In addition, the device may also comprise a first retainer in mechanical communication with the first receptacle, a second retainer in mechanical communication with the second receptacle, a third retainer in mechanical communication with the third receptacle, a fourth retainer in mechanical communication with the fourth receptacle, a fifth retainer in mechanical communication with the fifth receptacle, and a sixth retainer in mechanical communication with the sixth receptacle.

In some embodiments, the first retainer may be engaged when the first round is secured, the second retainer may be engaged when the second round is secured, the third retainer may be engaged when the third round is secured, the fourth retainer may be engaged when the fourth round is secured, the fifth retainer may be engaged when the fifth round is secured, and the sixth retainer may be engaged when the sixth round is secured. By way of example only, the first retainer and the second retainer may comprise a first button, the third retainer and the fourth retainer may comprise a second button, and the fifth retainer and the sixth retainer may comprise a third button. Moreover, the first button may be configured to disengage the first retainer and the second retainer, the second button may be configured to disengage the third retainer and the fourth retainer, and the third button may be configured to disengage the fifth retainer and the sixth retainer. Furthermore, the first retainer may be configured to release the first round when disengaged, the second retainer may be configured to release the second round when disengaged, the third retainer may be configured to release the third round when disengaged, the fourth retainer may be configured to release the fourth round when disengaged, the fifth retainer may be configured to release the fifth round when disengaged, and the sixth retainer may be configured to release the sixth round when disengaged.

In some embodiments, the first segment, the second segment, and the third segment may be in an open configuration. For demonstration purposes only, the open configuration of the first segment, the second segment, and the third segment may be configured to be substantially colinear. In addition, and for illustrative purposes only, the body may comprise a first actuator and a second actuator. Such that the first actuator is in mechanical communication with the first segment and the second segment; and the second actuator is in mechanical communication with the second segment and the third segment. Furthermore, the first actuator and the second actuator may be configured to change the first segment, the second segment, and the third segment between the open configuration and a closed configuration. Moreover, the closed configuration of the first segment, the second segment, and the third segment may be configured to interface with a cylinder of the firearm.

In one embodiment, a device for loading a firearm may be provided. The device may include a body defining a first segment and a second segment. In some aspects, the first segment may comprise a first receptacle, a second receptacle, and a third receptacle; and the second segment may comprise a fourth receptacle, a fifth receptacle, and a sixth receptacle. Furthermore, the first receptacle may be configured to accept a first round for use in the firearm, the second receptacle may be configured to accept a second round for use in the firearm, the third receptacle may be configured to accept a third round for use in the firearm, the fourth receptacle may be configured to accept a fourth round for use in the firearm, the fifth receptacle may be configured to accept a fifth round for use in the firearm, and the sixth receptacle may be configured to accept a sixth round for use in the firearm. The device may also comprise a first pivot point engaged between the first segment and the second segment. In addition, the device may also comprise a first retainer in mechanical communication with the first receptacle, a second retainer in mechanical communication with the second receptacle, a third retainer in mechanical communication with the third receptacle, a fourth retainer in mechanical communication with the fourth receptacle, a fifth retainer in mechanical communication with the fifth receptacle, and a sixth retainer in mechanical communication with the sixth receptacle.

In some embodiments, the first segment and the second segment may be configured to change between an open configuration and a closed configuration. By way of example only, the closed configuration of the first segment and the second segment may be configured to interface with a cylinder of a firearm.

Some embodiments may include a method for loading a firearm utilizing the device according to at least some of the embodiments described above. The method may include loading a first round into a first receptacle and a second round into a second receptacle, such that the first receptacle and the second receptacle are defined on a first segment. The method may also include loading a third round into a third receptacle and a fourth round into a fourth receptacle, such that the third receptacle and the fourth receptacle are defined on a second segment. The method may also include loading a fifth round into a fifth receptacle and a sixth round into a sixth receptacle, such that the fifth receptacle and the sixth receptacle are defined on a third segment. Such that, a first pivot point may engage between the first segment and the second segment, and a second pivot point may engage between the second segment and the third segment. The method may also include rotating the first segment about the first pivot point, the second segment about at least one of the first pivot point and the second pivot point, and the third segment about the second pivot point; such that, the first segment, the second segment, and the third segment may be reconfigured between an open configuration and a closed configuration. By way of example only, the method may also comprise interfacing the closed configuration of the first segment, the second segment, and the third segment with a cylinder of the firearm by aligning the first round to a first chamber of the cylinder, the second round to a second chamber of the cylinder, the third round to a third chamber of the cylinder, the fourth round to a fourth chamber of the cylinder, the fifth round to a fifth chamber of the cylinder, and the sixth round to a sixth chamber of the cylinder.

Some methods may include the open configuration of the first segment, the second segment, and the third segment, such that the open configuration may be configured to be substantially colinear.

Some methods may include engaging a first actuator and a second actuator, such that the first actuator may be configured to rotate the first segment and the second segment about the first pivot point, and the second actuator may be configured to rotate the second segment and the third segment about the second pivot point.

Some methods may include engaging a first retainer to secure the first round substantially within the first receptacle, engaging a second retainer to secure the second round substantially within the second receptacle, engaging a third retainer to secure the third round substantially within the third receptacle, engaging a fourth retainer to secure the fourth round substantially within the fourth receptacle, engaging a fifth retainer to secure the fifth round substantially within the fifth receptacle, and engaging a sixth retainer to secure the sixth round substantially within the sixth receptacle. For illustrative purposes, the method may also comprise disengaging the first retainer to release the first round from the first receptacle, disengaging the second retainer to release the second round from the second receptacle, disengaging the third retainer to release the third round from the third receptacle, disengaging the fourth retainer to release the fourth round from the fourth receptacle, disengaging the fifth retainer to release the fifth round from the fifth receptacle, and disengaging the sixth retainer to release the sixth round from the sixth receptacle. Furthermore, the method may also include actuating a first button to disengage the first retainer and the second retainer, actuating a second button to disengage the third retainer and the fourth retainer, and actuating a third button to disengage the fifth retainer and the sixth retainer. In addition, the method may also incorporate retaining the first round, the second round, the third round, the fourth round, the fifth round, and the sixth round substantially within the cylinder of the firearm.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographers, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 2A:
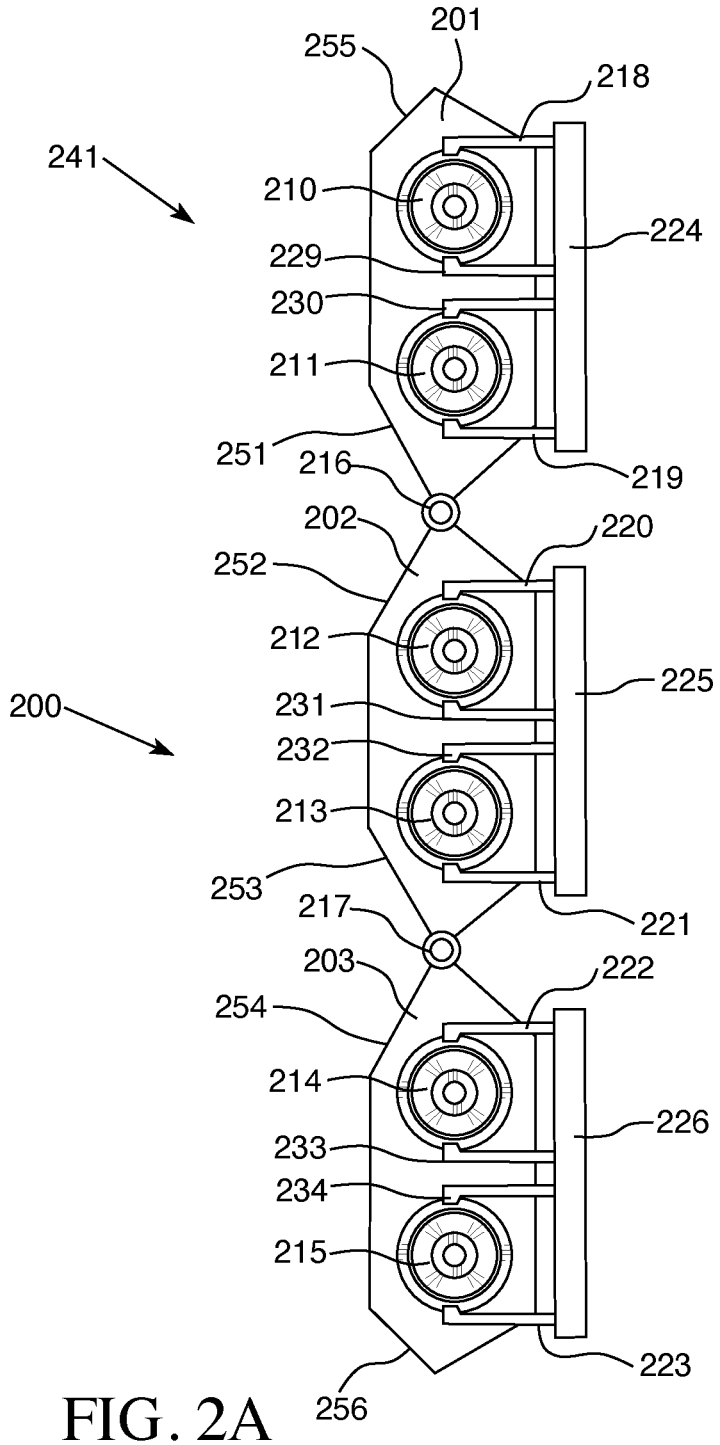
FIG. 2A depicts a front view of a second embodiment of a device for loading a firearm in an open configuration, according to aspects of the present disclosure.
Figure 2B:
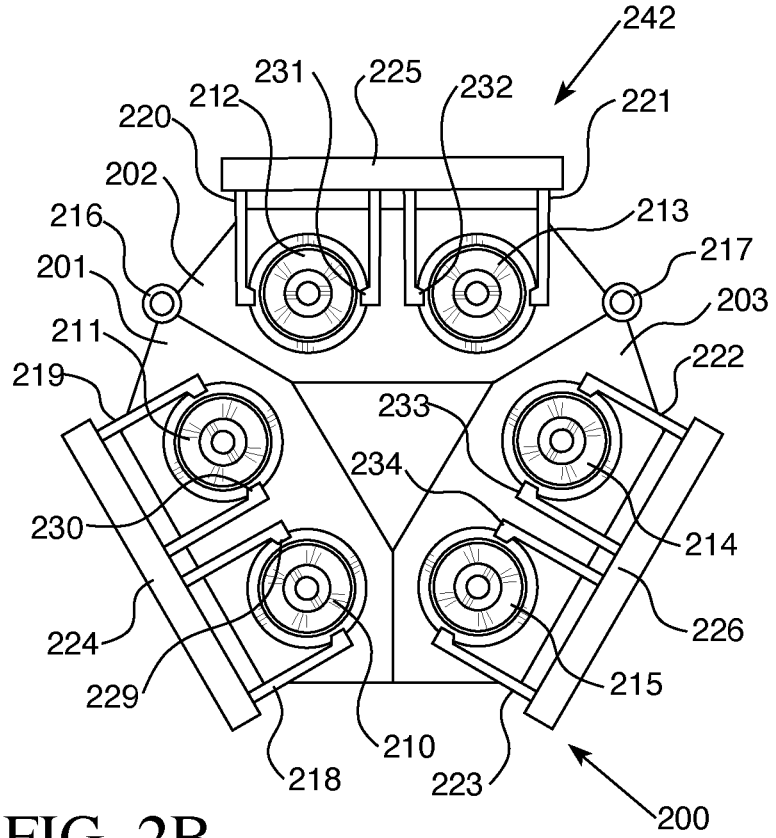
FIG. 2B depicts a front view of the second embodiment of the device in a closed configuration with the retainers engaged, according to aspects of the present disclosure.
Figure 2C:
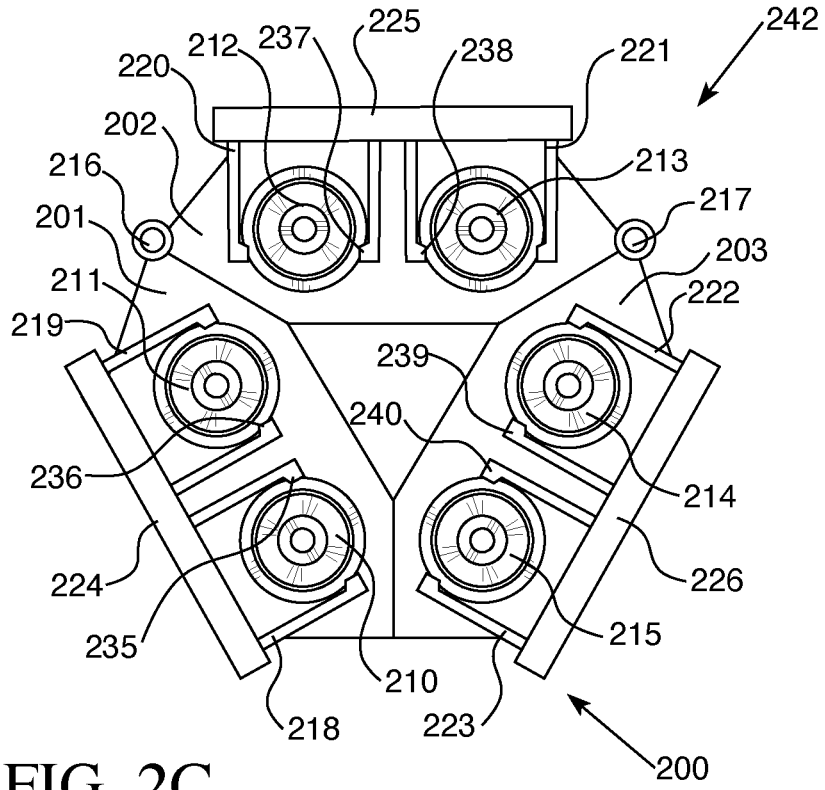
FIG. 2C depicts a front view of the second embodiment of the device in a closed configuration with the retainers disengaged, according to aspects of the present disclosure.
Figure 3A:
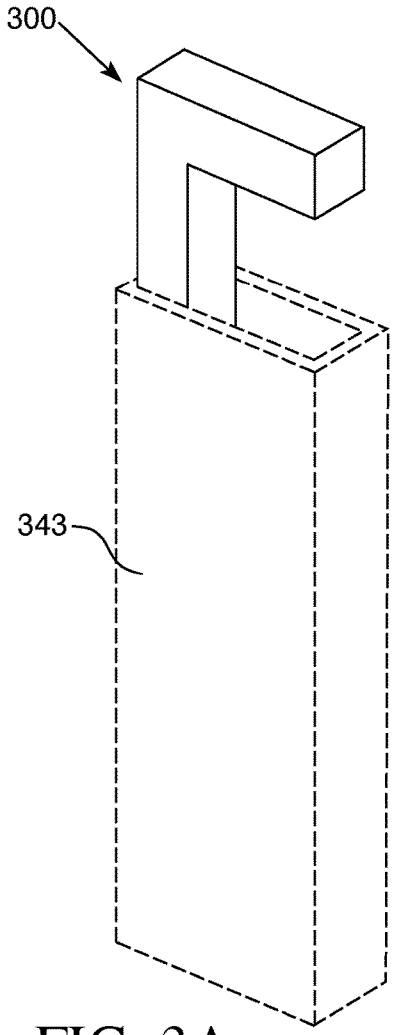
FIG. 3A depicts a perspective view of a third embodiment of a device for loading a firearm in an open configuration in a carrying case, according to aspects of the present disclosure.
Figure 3C:
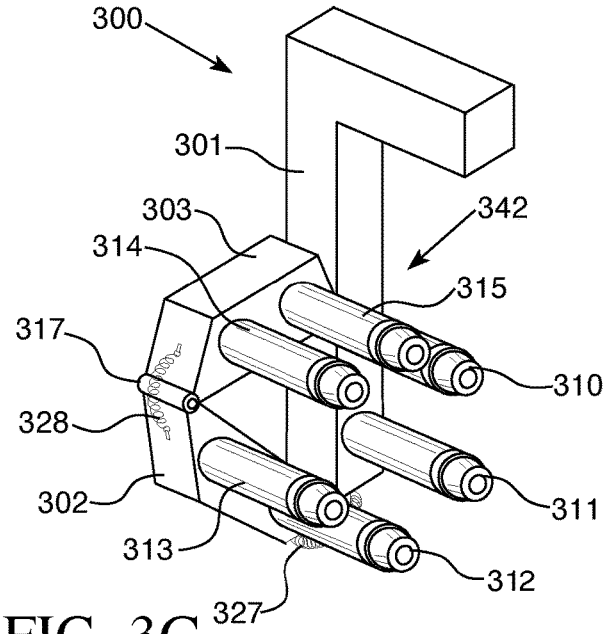
FIG. 3C depicts a perspective view of the third embodiment of the device in a closed configuration, according to aspects of the present disclosure.
Figure 3B:
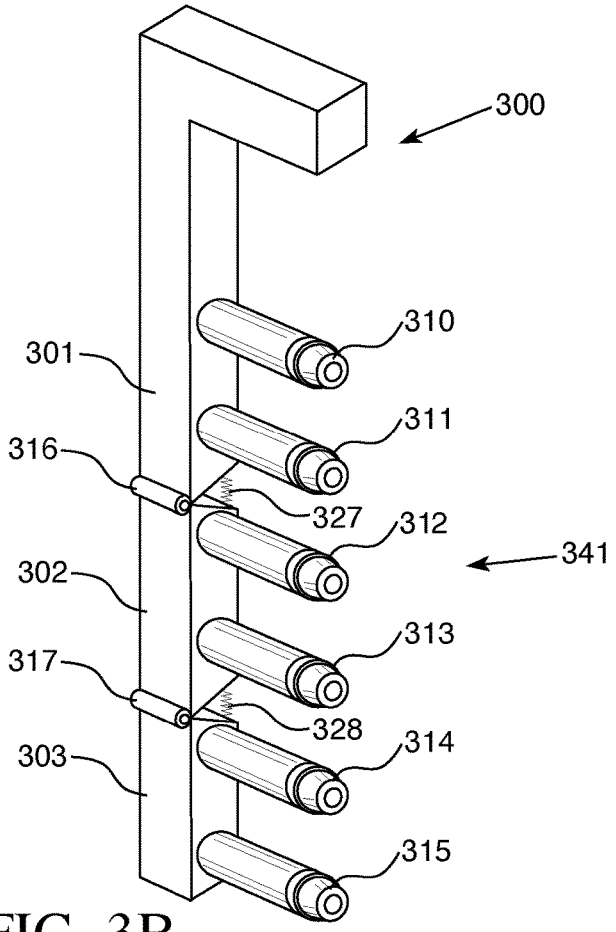
FIG. 3B depicts a perspective view of the third embodiment of the device in an open configuration, according to aspects of the present disclosure.
Figure 5A:
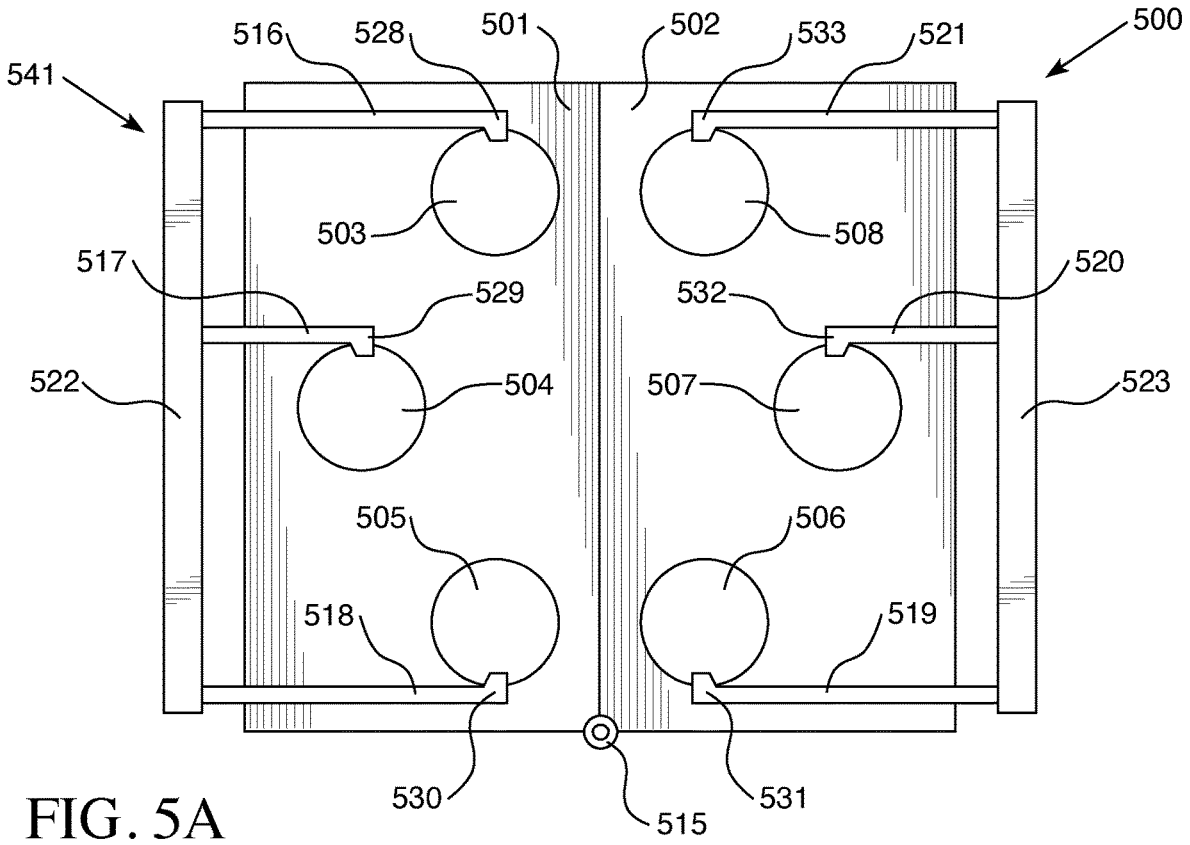
FIG. 5A depicts a front view of a fifth embodiment of a device for loading a firearm with the retainers in the engaged position, according to aspects of the present disclosure.
Figure 5B:
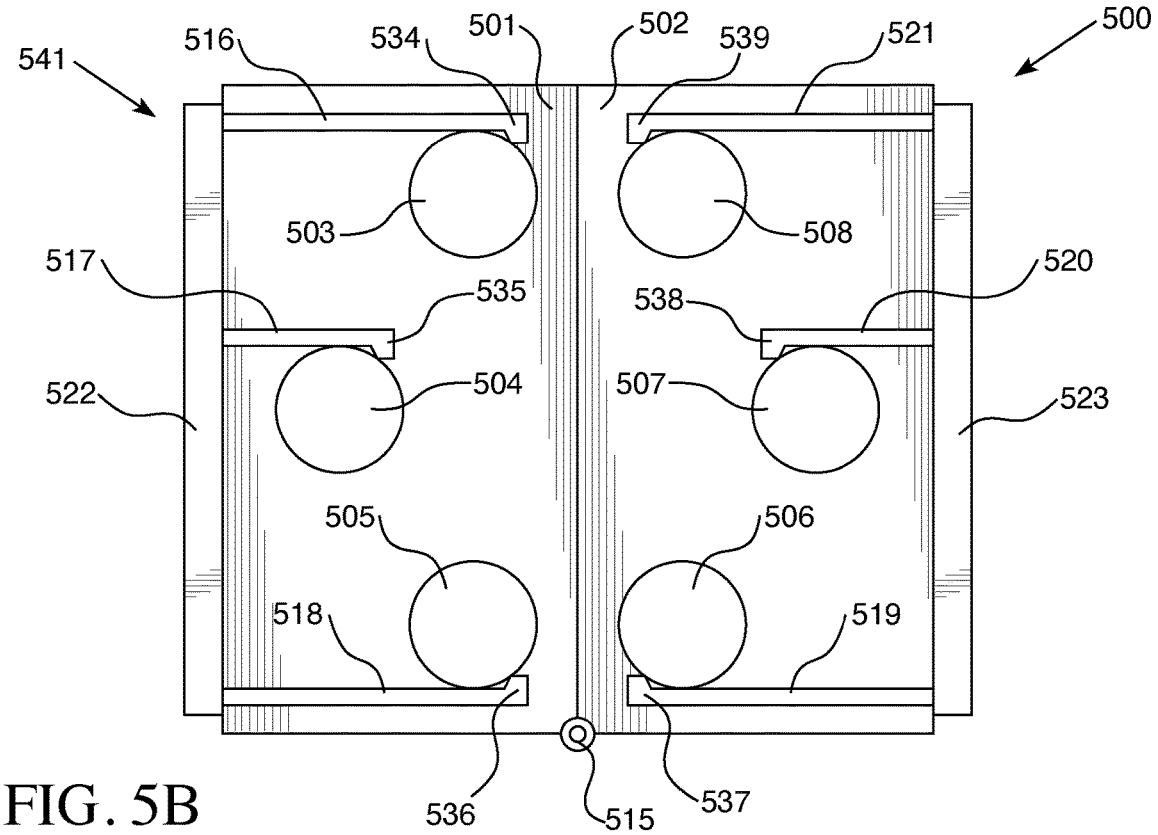
FIG. 5B depicts a front view of the fifth embodiment of the device with the retainers in the disengaged position, according to aspects of the present disclosure.
Figure 6A:
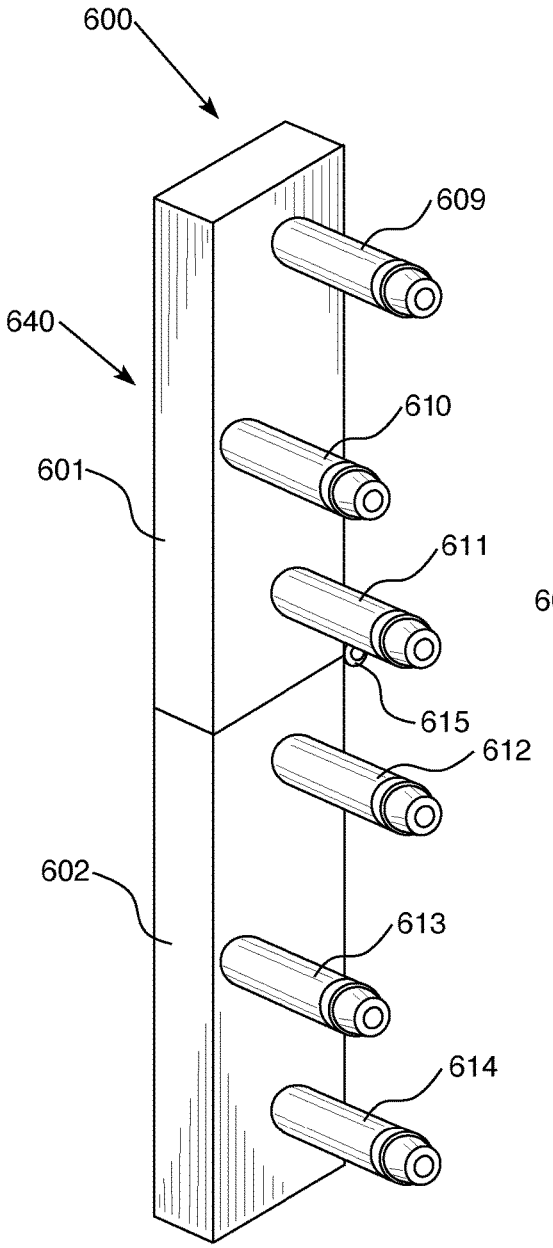
FIG. 6A depicts a perspective view of a sixth embodiment of a device for loading a firearm in an open configuration, according to aspects of the present disclosure.
Figure 6B:
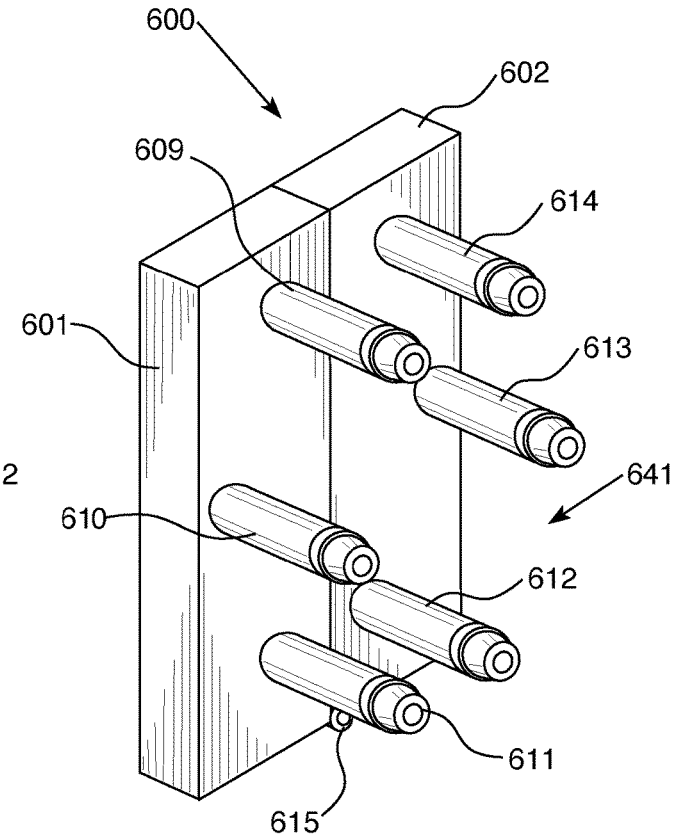
FIG. 6B depicts a perspective view of the sixth embodiment of the device in a closed configuration, according to aspects of the present disclosure.

Referring to the drawings, embodiments of devices for loading a firearm are generally illustrated in FIGS. 1A, 1B, 1C, 1D, and 1E; FIGS. 2A, 2B, and 2C; FIGS. 3A, 3B, and 3C; FIGS. 4A, 4B, 4C, 4D, and 4E; FIGS. 5A and 5B; FIGS. 6A and 6B; and FIGS. 7A, 7B, 7C, and 7D. In some embodiments, the device can be configured to be arranged in an open configuration and a closed configuration. Moreover, the closed configuration of the device may be able to interface with a cylinder of a firearm.

Figure 1A:
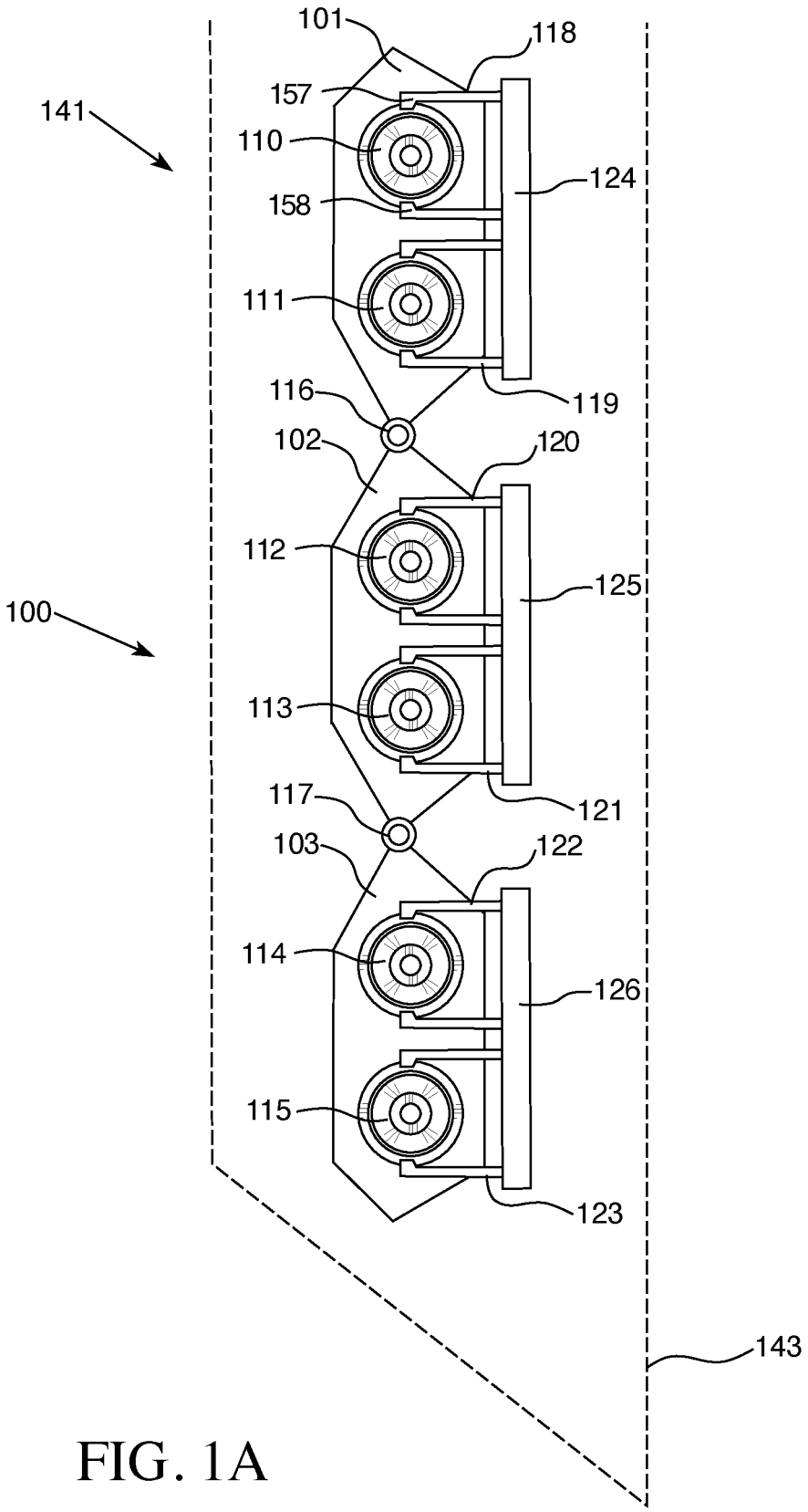
FIG. 1A depicts a front view of a first embodiment of a device for loading a firearm in an open configuration in a carrying case, according to aspects of the present disclosure.
Figure 1B:
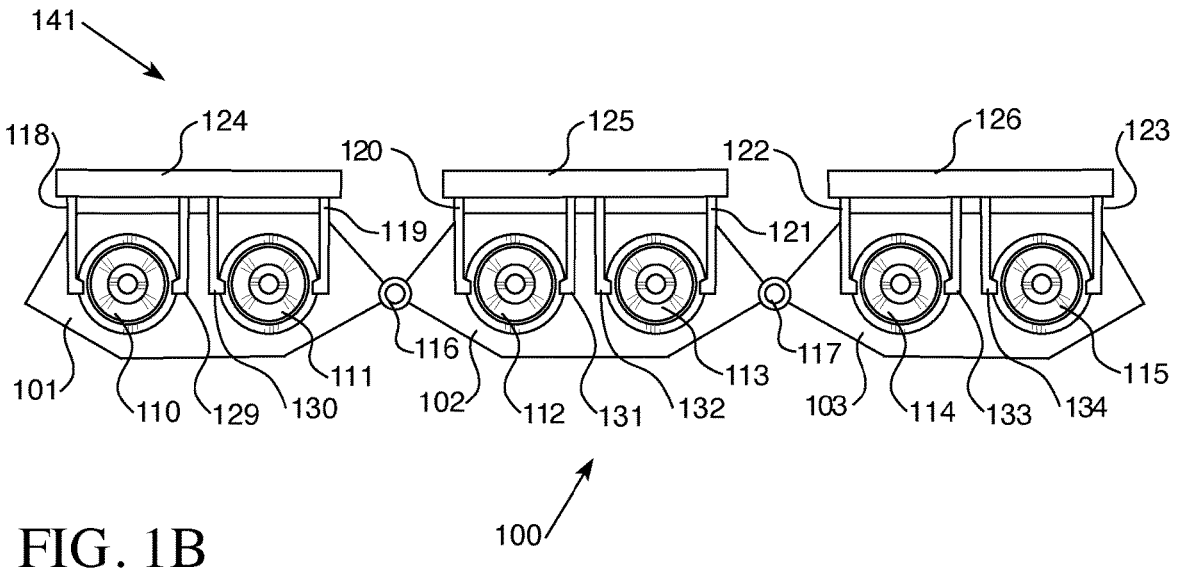
FIG. 1B depicts a front view of the first embodiment of the device in an open configuration, according to aspects of the present disclosure.
Figure 1C:
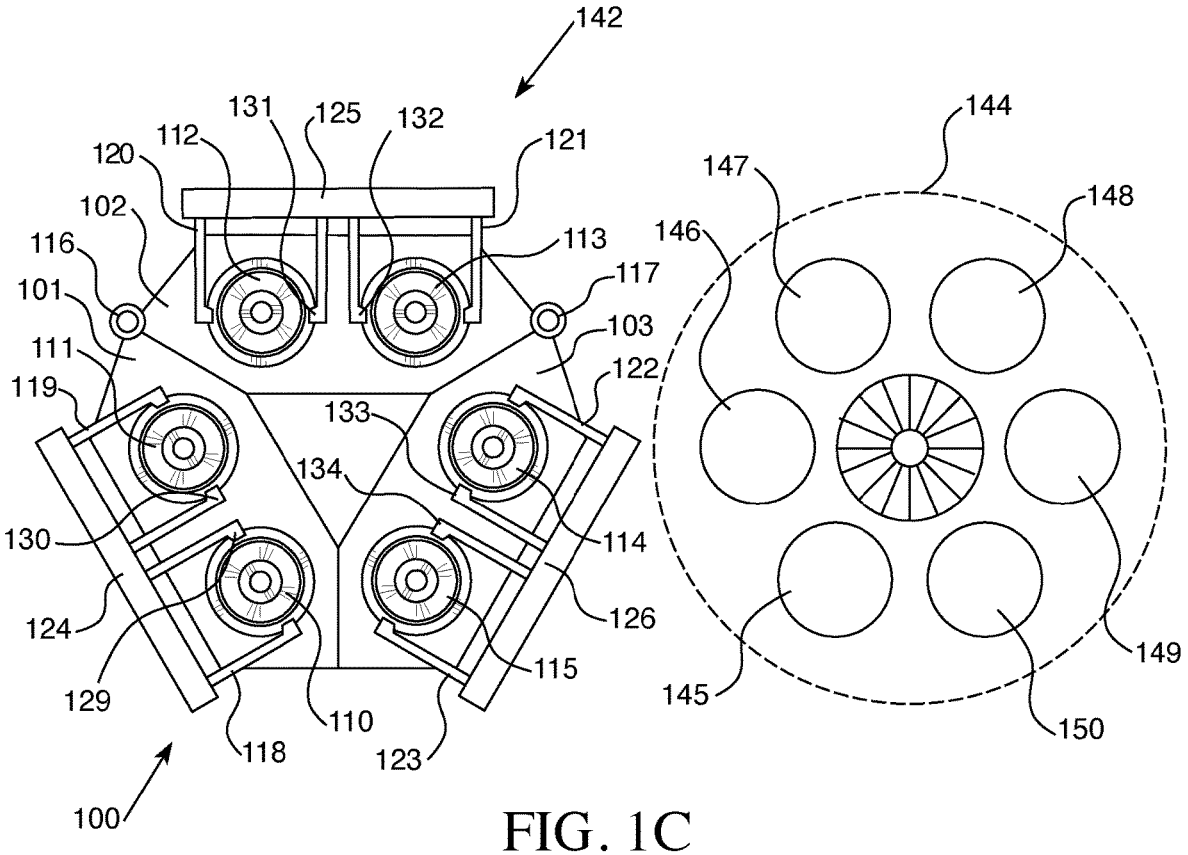
FIG. 1C depicts a front view of the first embodiment of the device in a closed configuration with a cylinder of a firearm, according to aspects of the present disclosure.
Figure 1D:
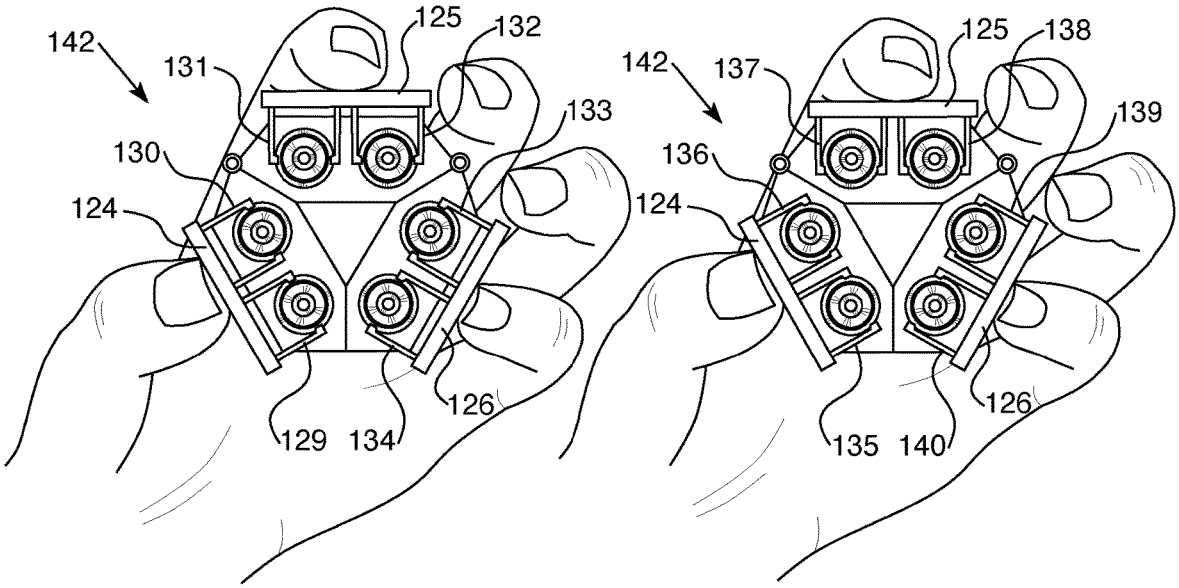
FIG. 1D depicts a user interacting with a front view of the first embodiment of the device in a closed configuration, according to aspects of the present disclosure.
Figure 1E:
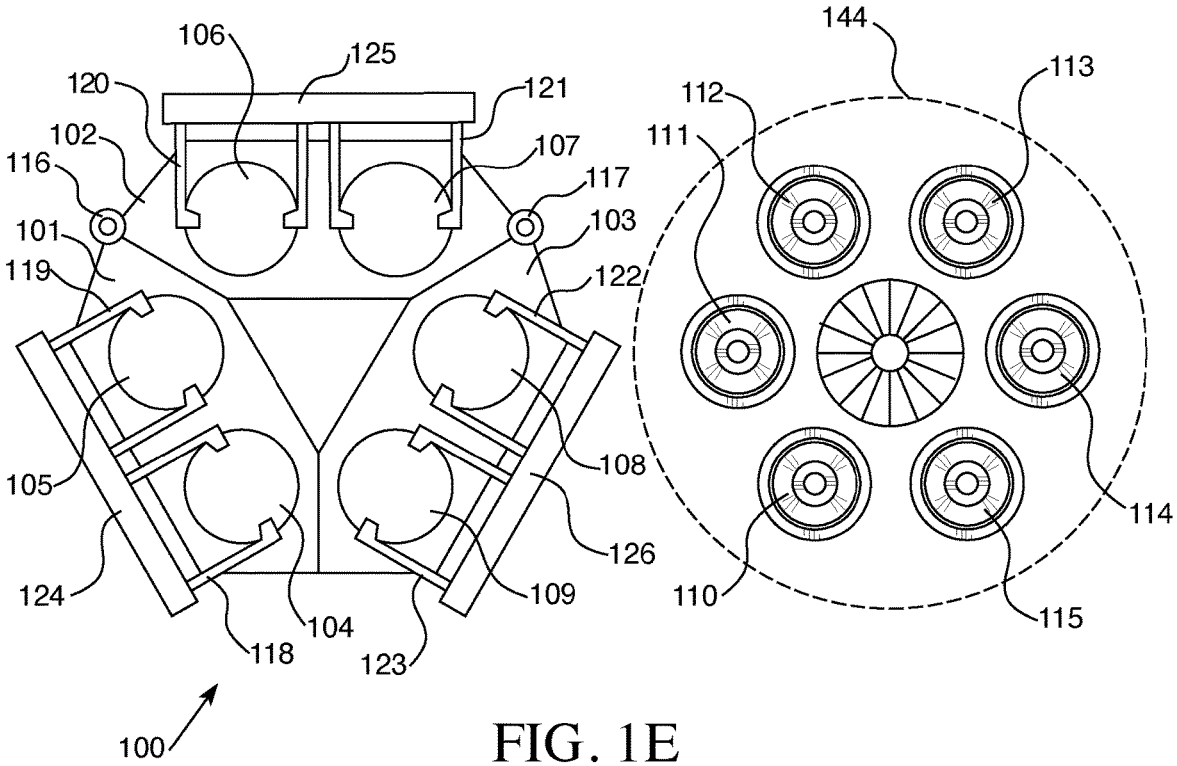
FIG. 1E depicts a front view of the first embodiment of the device in a closed configuration with the cylinder of a firearm, according to aspects of the present disclosure.

FIGS. 1A through 1E illustrate a first embodiment of a device. The device may include a body 100, a first segment 101, a second segment 102, a third segment 103, a first receptacle 104, a second receptacle 105, a third receptacle 106, a fourth receptacle 107, a fifth receptacle 108, a sixth receptacle 109, a first pivot point 116, a second pivot point 117, a first retainer 118, a second retainer 119, a third retainer 120, a fourth retainer 121, a fifth retainer 122, a sixth retainer 123, a first button 124, a second button 125, and a third button 126. The first segment 101, the second segment 102, and the third segment 103 may be configured in an open configuration 141 as shown in FIGS. 1A and 1B. Similarly, the first segment 101, the second segment 102, and the third segment 103 may be configured in a closed configuration 142 as shown in FIGS. 1C, 1D, and 1E.

In some embodiments, the first segment 101 may comprise the first receptacle 104 and the second receptacle 105; such that, the first receptacle 104 may be configured to accept a first round 110, and the second receptacle 105 may be configured to accept a second round 111. In addition, the second segment 102 may comprise the third receptacle 106 and the fourth receptacle 107; such that, the third receptacle 106 may be configured to accept a third round 112, and the fourth receptacle 107 may be configured to accept a fourth round 113. Furthermore, the third segment 103 may comprise the fifth receptacle 108 and the sixth receptacle 109; such that, the fifth receptacle 108 may be configured to accept a fifth round 114, and the sixth receptacle 109 may be configured to accept a sixth round 115.

In some embodiments, the first receptacle 104 may be circular, such that the body of the first round 110 may be encircled by the first receptacle 104. Moreover, the second receptacle 105 may be circular, such that the body of the second round 111 may be encircled by the second receptacle 105. In addition, the third receptacle 106 may be circular, such that the body of the third round 112 may be encircled by the third receptacle 106. Similarly, the fourth receptacle 107 may be circular, such that the body of the fourth round 113 may be encircled by the fourth receptacle 107. Furthermore, the fifth receptacle 108 may be circular, such that the body of the fifth round 114 may be encircled by the fifth receptacle 108. Likewise, the sixth receptacle 109 may be circular, such that the body of the sixth round 115 may be encircled by the sixth receptacle 109.

In some embodiments, the first retainer 118 may be in mechanical communication with the first receptacle 104, the second retainer 119 may be in mechanical communication with the second receptacle 105, the third retainer 120 may be in mechanical communication with the third receptacle 106, the fourth retainer 121 may be in mechanical communication with the fourth receptacle 107, the fifth retainer 122 may be in mechanical communication with the fifth receptacle 108, and the sixth retainer 123 may be in mechanical communication with the sixth receptacle 109. If the first round 110 is accepted within the first receptacle 104, the first retainer 118 may be engaged 129. Similarly, if the second round 111 is accepted within the second receptacle 105, the second retainer 119 may be engaged 130. Moreover, if the third round 112 is accepted within the third receptacle 106, the third retainer 120 may be engaged 131. Furthermore, if the fourth round 113 is accepted within the fourth receptacle 107, the fourth retainer 121 may be engaged 132. In addition, if the fifth round 114 is accepted within the fifth receptacle 108, the fifth retainer 122 may be engaged 133.

Likewise, if the sixth round 115 is accepted within the sixth receptacle 109, the sixth retainer 123 may be engaged 134.

In some embodiments, the first retainer 118 may engage with the rim of the first round 110, the second retainer 119 may engage with the rim of the second round 111, the third retainer 120 may engage with the rim of the third round 112, the fourth retainer 121 may engage with the rim of the fourth round 113, the fifth retainer 122 may engage with the rim of the fifth round 114, and the sixth retainer 123 may engage with the rim of the sixth round 115. In other embodiments, the retainers may engage with an extractor groove of a rimless round.

In some embodiments, each retainer may comprise a first retainment arm 157 and a second retainment arm 158. The first retainment arm 157 may be positioned opposite of the second retainment arm 158, such that, the first retainment arm 157 and the second retainment arm 158 may secure opposite sides of a round 110. Comparatively, in other embodiments, each retainer may comprise a substantially U-shaped arm, such that the two tops of the U may secure the round in place. Also comparatively, in other embodiments, a single retainment arm may be used to interface with the rim or extractor groove of a round. In addition, and for demonstration purposes only, if each receptacle is circular, then each receptacle may keep each round secured horizontally. This may allow the rounds to rest in their receptacles, without falling out of the side of the receptacle. Furthermore, if the round's respective retainer is engaged to the round, that may keep each round vertically secured. This may allow the rounds to rest in their receptacles, without falling out of the back or front of their receptacle.

In some embodiments, the first retainer 118 and the second retainer 119 may comprise the first button 124, the third retainer 120 and the fourth retainer 121 may comprise the second button 125, and the fifth retainer 122 and the sixth retainer 123 may comprise the third button 126. In other embodiments, each retainer may comprise its own individual button. Moreover, in other embodiments, there may be a single button that will correspond to all of the retainers. For demonstration purposes only, the first button 124 may be configured to disengage the first retainer 118 and the second retainer 119, the second button 125 may be configured to disengage the third retainer 120 and the fourth retainer 121, and the third button 126 may be configured to disengage the fifth retainer 122 and the sixth retainer 123. This is shown in FIG. 1D as the disengagement of the first retainer 135, the disengagement of the second retainer 136, the disengagement of the third retainer 137, the disengagement of the fourth retainer 138, the disengagement of the fifth retainer 139, and the disengagement of the sixth retainer 140.

In some embodiments, the disengagement of the first retainer 135 may release the first round 110 from the first receptacle 104, the disengagement of the second retainer 136 may release the second round 111 from the second receptacle 105, the disengagement of the third retainer 137 may release the third round 112 from the third receptacle 106, the disengagement of the fourth retainer 138 may release the fourth round 113 from the fourth receptacle 107, the disengagement of the fifth retainer 139 may release the fifth round 114 from the fifth receptacle 108, and the disengagement of the sixth retainer 140 may release the sixth round 115 from the sixth receptacle 109.

In some embodiments, the first pivot point 116 may be rotatably engaged between the first segment 101 and the second segment 102. Similarly, the second pivot point 117 may be rotatably engaged between the second segment 102 and the third segment 103. By way of example, the first segment 101 may be rotated about the first pivot point 116, and the third segment 103 may be rotated about the second pivot point 117. In comparison, the second segment 102 may be rotated about the first pivot point 116 or the second pivot point 117. If the first segment 101, the second segment 102, and the third segment 103 are rotated, the first segment 101, the second segment 102, and the third segment 103 may be changed between the open configuration 141 and the closed configuration 142. Furthermore, the rotation of the first segment 101 and the third segment 103 may change the configuration of the first segment 101, the second segment 102, and the third segment 103 between the open configuration 141 and the closed configuration 142.

In some embodiments, the closed configuration 142 of the first segment 101, the second segment 102, and the third segment 103 may be configured to interface with a cylinder 144 of a firearm. For example, the firearm may be a revolver. For illustrative purposes only, the first receptacle 104 may align with a first chamber 145 of the cylinder 144, the second receptacle 105 may align with a second chamber 146 of the cylinder 144, the third receptacle 106 may align with a third chamber 147 of the cylinder 144, the fourth receptacle 107 may align with a fourth chamber 148 of the cylinder 144, the fifth receptacle 108 may align with a fifth chamber 149 of the cylinder 144, and the sixth receptacle 109 may align with a sixth chamber 150 of the cylinder 144. Moreover, if the first round 110 has been loaded into the first receptacle 104, the second round 111 has been loaded into the second receptacle 105, the third round 112 has been loaded into the third receptacle 106, the fourth round 113 has been loaded into the fourth receptacle 107, the fifth round 114 has been loaded into the fifth receptacle 108, and the sixth round 115 has been loaded into the sixth receptacle 109. Also, if the closed configuration 142 of the first segment 101, the second segment 102, and the third segment 103 is aligned with the cylinder 144. And if the first button 124 has disengaged the first retainer 135 and the second retainer 136, the second button 125 has disengaged the third retainer 137 and the fourth retainer 138, and the third button 126 has disengaged the fifth retainer 139 and the sixth retainer 140. Then, the first round 110 may be loaded and retained within the first chamber 145 of the cylinder 144, the second round 111 may be loaded and retained within the second chamber 146 of the cylinder 144, the third round 112 may be loaded and retained within the third chamber 147 of the cylinder 144, the fourth round 113 may be loaded and retained within the fourth chamber 148 of the cylinder 144, the fifth round 114 may be loaded and retained within the fifth chamber 149 of the cylinder 144, and the sixth round 115 may be loaded and retained within the sixth chamber 150 of the cylinder 144. At this time, the firearm may be loaded and ready to be discharged.

In some embodiments, the open configuration 141 of the first segment 101, the second segment 102, and the third segment 103 may be configured to be substantially colinear. Furthermore, and solely for the purposes of demonstration, the open configuration 141 of the first segment 101, the second segment 102, and the third segment 103 may be configured to substantially rest inside a carrying case 143. In other embodiments, the open configuration 141 of the first segment 101, the second segment 102, and the third segment 103 may be configured to substantially rest within a pocket of an article of clothing.

In some embodiments, the first segment 101 may have a first angled edge; the second segment 102 may have a second angled edge and a third angled edge; and the third segment 103 may have a fourth angled edge. The first angled edge may be configured to interface with the second angled edge, and the third angled edge may be configured to interface with the fourth angled edge. This may allow the closed configuration 142 of the first segment 101, the second segment 102, and the third segment 103 to form a substantially circular structure, such that the receptacles of the segments align with the chambers of a cylinder of a firearm. In addition, the first segment 101 may further comprise a fifth angled edge, and the third segment 103 may further comprise a sixth angled edge. For example, the fifth angled edge may be configured to interface with the sixth angled edge in the closed configuration 142 of the first segment 101, the second segment 102, and the third segment 103.

FIGS. 2A through 2C illustrate a second embodiment of a device. The device may include a body 200, a first segment 201, a second segment 202, a third segment 203, a first receptacle 204, a second receptacle 205, a third receptacle 206, a fourth receptacle 207, a fifth receptacle 208, a sixth receptacle 209, a first pivot point 216, a second pivot point 217, a first retainer 218, a second retainer 219, a third retainer 220, a fourth retainer 221, a fifth retainer 222, a sixth retainer 223, a first button 224, a second button 225, and a third button 226. The first segment 201, the second segment 202, and the third segment 203 may be configured in an open configuration 241 as shown in FIG. 2A. Similarly, the first segment 201, the second segment 202, and the third segment 203 may be configured in a closed configuration 242 as shown in FIGS. 2B and 2C.

In some embodiments, the first segment 201 may comprise the first receptacle 204 and the second receptacle 205; such that, the first receptacle 204 may be configured to accept a first round 210, and the second receptacle 205 may be configured to accept a second round 211. In addition, the second segment 202 may comprise the third receptacle 206 and the fourth receptacle 207; such that, the third receptacle 206 may be configured to accept a third round 212, and the fourth receptacle 207 may be configured to accept a fourth round 213. Furthermore, the third segment 203 may comprise the fifth receptacle 208 and the sixth receptacle 209; such that, the fifth receptacle 208 may be configured to accept a fifth round 214, and the sixth receptacle 209 may be configured to accept a sixth round 215.

In some embodiments, the first receptacle 204 may be circular, such that the body of the first round 210 may be encircled by the first receptacle 204. Moreover, the second receptacle 205 may be circular, such that the body of the second round 211 may be encircled by the second receptacle 205. In addition, the third receptacle 206 may be circular, such that the body of the third round 212 may be encircled by the third receptacle 206. Similarly, the fourth receptacle 207 may be circular, such that the body of the fourth round 213 may be encircled by the fourth receptacle 207. Furthermore, the fifth receptacle 208 may be circular, such that the body of the fifth round 214 may be encircled by the fifth receptacle 208. Likewise, the sixth receptacle 209 may be circular, such that the body of the sixth round 215 may be encircled by the sixth receptacle 209.

In some embodiments, the first retainer 218 may be in mechanical communication with the first receptacle 204, the second retainer 219 may be in mechanical communication with the second receptacle 205, the third retainer 220 may be in mechanical communication with the third receptacle 206, the fourth retainer 221 may be in mechanical communication with the fourth receptacle 207, the fifth retainer 222 may be in mechanical communication with the fifth receptacle 208, and the sixth retainer 223 may be in mechanical communication with the sixth receptacle 209. If the first round 210 is accepted within the first receptacle 204, the first retainer 218 may be engaged 229. Similarly, if the second round 211 is accepted within the second receptacle 205, the second retainer 219 may be engaged 230. Moreover, if the third round 212 is accepted within the third receptacle 206, the third retainer 220 may be engaged 231. Furthermore, if the fourth round 213 is accepted within the fourth receptacle 207, the fourth retainer 221 may be engaged 232. In addition, if the fifth round 214 is accepted within the fifth receptacle 208, the fifth retainer 222 may be engaged 233. Likewise, if the sixth round 215 is accepted within the sixth receptacle 209, the sixth retainer 223 may be engaged 234.

In some embodiments, the first retainer 218 may engage with the rim of the first round 210, the second retainer 219 may engage with the rim of the second round 211, the third retainer 220 may engage with the rim of the third round 212, the fourth retainer 221 may engage with the rim of the fourth round 213, the fifth retainer 222 may engage with the rim of the fifth round 214, and the sixth retainer 223 may engage with the rim of the sixth round 215. In other embodiments, the retainers may engage with an extractor groove of a rimless round.

In some embodiments, each retainer may comprise a first retainment arm and a second retainment arm. The first retainment arm may be positioned opposite of the second retainment arm, such that, the first retainment arm and the second retainment arm may secure opposite sides of a round. Comparatively, in other embodiments, each retainer may comprise a substantially U-shaped arm, such that the two tops of the U may secure the round in place. Also comparatively, in other embodiments, a single retainment arm may be used to interface with the rim or extractor groove of a round. In addition, and for demonstration purposes only, if each receptacle is circular, then each receptacle may keep each round secured horizontally. This may allow the rounds to rest in their receptacles, without falling out of the side of the receptacle. Furthermore, if the round's respective retainer is engaged to the round, that may keep each round vertically secured. This may allow the rounds to rest in their receptacles, without falling out of the back or front of their receptacle.

In some embodiments, the first retainer 218 and the second retainer 219 may comprise the first button 224, the third retainer 220 and the fourth retainer 221 may comprise the second button 225, and the fifth retainer 222 and the sixth retainer 223 may comprise the third button 226. In other embodiments, each retainer may comprise its own individual button. Moreover, in other embodiments, there may be a single button that will correspond to all of the retainers. For demonstration purposes only, the first button 224 may be configured to disengage the first retainer 218 and the second retainer 219, the second button 225 may be configured to disengage the third retainer 220 and the fourth retainer 221, and the third button 226 may be configured to disengage the fifth retainer 222 and the sixth retainer 223. This is shown in FIG. 2C as the disengagement of the first retainer 235, the disengagement of the second retainer 236, the disengagement of the third retainer 237, the disengagement of the fourth retainer 238, the disengagement of the fifth retainer 239, and the disengagement of the sixth retainer 240.

In some embodiments, the disengagement of the first retainer 235 may release the first round 210 from the first receptacle 204, the disengagement of the second retainer 236 may release the second round 211 from the second receptacle 205, the disengagement of the third retainer 237 may release the third round 212 from the third receptacle 206, the disengagement of the fourth retainer 238 may release the fourth round 213 from the fourth receptacle 207, the disengagement of the fifth retainer 239 may release the fifth round 214 from the fifth receptacle 208, and the disengagement of the sixth retainer 240 may release the sixth round 215 from the sixth receptacle 209.

In some embodiments, the first pivot point 216 may be rotatably engaged between the first segment 201 and the second segment 202. Similarly, the second pivot point 217 may be rotatably engaged between the second segment 202 and the third segment 203. By way of example, the first segment 201 may be rotated about the first pivot point 216, and the third segment 203 may be rotated about the second pivot point 217. In comparison, the second segment 202 may be rotated about the first pivot point 216 or the second pivot point 217. If the first segment 201, the second segment 202, and the third segment 203 are rotated, the first segment 201, the second segment 202, and the third segment 203 may be changed between the open configuration 241 and the closed configuration 242. Furthermore, the rotation of the first segment 201 and the third segment 203 may change the configuration of the first segment 201, the second segment 202, and the third segment 203 between the open configuration 241 and the closed configuration 242.

In some embodiments, the closed configuration 242 of the first segment 201, the second segment 202, and the third segment 203 may be configured to interface with a cylinder of a firearm. For example, the firearm may be a revolver. For illustrative purposes only, the first receptacle 204 may align with a first chamber of the cylinder, the second receptacle 205 may align with a second chamber of the cylinder, the third receptacle 206 may align with a third chamber of the cylinder, the fourth receptacle 207 may align with a fourth chamber of the cylinder, the fifth receptacle 208 may align with a fifth chamber of the cylinder, and the sixth receptacle 209 may align with a sixth chamber of the cylinder. Moreover, if the first round 210 has been loaded into the first receptacle 204, the second round 211 has been loaded into the second receptacle 205, the third round 212 has been loaded into the third receptacle 206, the fourth round 213 has been loaded into the fourth receptacle 207, the fifth round 214 has been loaded into the fifth receptacle 208, and the sixth round 215 has been loaded into the sixth receptacle 209. Also, if the closed configuration 242 of the first segment 201, the second segment 202, and the third segment 203 is aligned with the cylinder. And if the first button 224 has disengaged the first retainer 235 and the second retainer 236, the second button 225 has disengaged the third retainer 237 and the fourth retainer 238, and the third button 226 has disengaged the fifth retainer 239 and the sixth retainer 240. Then, the first round 210 may be loaded and retained within the first chamber of the cylinder, the second round 211 may be loaded and retained within the second chamber of the cylinder, the third round 212 may be loaded and retained within the third chamber of the cylinder, the fourth round 213 may be loaded and retained within the fourth chamber of the cylinder, the fifth round 214 may be loaded and retained within the fifth chamber of the cylinder, and the sixth round 215 may be loaded and retained within the sixth chamber of the cylinder. At this time, the firearm may be loaded and ready to be discharged.

In some embodiments, the open configuration 241 of the first segment 201, the second segment 202, and the third segment 203 may be configured to be substantially colinear. Furthermore, and solely for the purposes of demonstration, the open configuration 241 of the first segment 201, the second segment 202, and the third segment 203 may be configured to substantially rest inside a carrying case. In other embodiments, the open configuration 241 of the first segment 201, the second segment 202, and the third segment 203 may be configured to substantially rest within a pocket of an article of clothing.

In some embodiments, the first segment 201 may have a first angled edge 251; the second segment 202 may have a second angled edge 252 and a third angled edge 253; and the third segment 203 may have a fourth angled edge 254. The first angled edge 251 may be configured to interface with the second angled edge 252, and the third angled edge 253 may be configured to interface with the fourth angled edge 254. This may allow the closed configuration 242 of the first segment 201, the second segment 202, and the third segment 203 to form a substantially circular structure, such that the receptacles of the segments align with the chambers of a cylinder of a firearm. In addition, the first segment 201 may further comprise a fifth angled edge 255, and the third segment 203 may further comprise a sixth angled edge 256. For example, the fifth angled edge 255 may be configured to interface with the sixth angled edge 256 in the closed configuration 242 of the first segment 201, the second segment 202, and the third segment 203.

FIGS. 3A through 3C illustrate a third embodiment of a device. The device may include a body 300, a first segment 301, a second segment 302, a third segment 303, a first receptacle (not shown), a second receptacle (not shown), a third receptacle (not shown), a fourth receptacle (not shown), a fifth receptacle (not shown), a sixth receptacle (not shown), a first pivot point 316, a second pivot point 317, a first receptacle (not shown), a second receptacle (not shown), a third receptacle (not shown), a fourth receptacle (not shown), a fifth receptacle (not shown), a sixth receptacle (not shown), a first actuator 327, and a second actuator 328. The first segment 301, the second segment 302, and the third segment 303 may be configured in an open configuration 341 as shown in FIG. 3B. Similarly, the first segment 301, the second segment 302, and the third segment 303 may be configured in a closed configuration 342 as shown in FIG. 3C.

In some embodiments, the first segment 301 may comprise the first receptacle and the second receptacle; such that, the first receptacle may be configured to accept a first round 310, and the second receptacle may be configured to accept a second round 311. In addition, the second segment 302 may comprise the third receptacle and the fourth receptacle; such that, the third receptacle may be configured to accept a third round 312, and the fourth receptacle may be configured to accept a fourth round 313. Furthermore, the third segment 303 may comprise the fifth receptacle and the sixth receptacle; such that, the fifth receptacle may be configured to accept a fifth round 314, and the sixth receptacle may be configured to accept a sixth round 315.

In some embodiments, the first receptacle may be circular, such that the body of the first round 310 may be encircled by the first receptacle. Moreover, the second receptacle may be circular, such that the body of the second round 311 may be encircled by the second receptacle. In addition, the third receptacle may be circular, such that the body of the third round 312 may be encircled by the third receptacle. Similarly, the fourth receptacle may be circular, such that the body of the fourth round 313 may be encircled by the fourth receptacle. Furthermore, the fifth receptacle may be circular, such that the body of the fifth round 314 may be encircled by the fifth receptacle. Likewise, the sixth receptacle may be circular, such that the body of the sixth round 315 may be encircled by the sixth receptacle.

In some embodiments, a first retainer may be in mechanical communication with the first receptacle, a second retainer may be in mechanical communication with the second receptacle, a third retainer may be in mechanical communication with the third receptacle, a fourth retainer may be in mechanical communication with the fourth receptacle, a fifth retainer may be in mechanical communication with the fifth receptacle, and a sixth retainer may be in mechanical communication with the sixth receptacle. If the first round 310 is accepted within the first receptacle, the first retainer may be engaged. Similarly, if the second round 311 is accepted within the second receptacle, the second retainer may be engaged. Moreover, if the third round 312 is accepted within the third receptacle, the third retainer may be engaged. Furthermore, if the fourth round 313 is accepted within the fourth receptacle, the fourth retainer may be engaged. In addition, if the fifth round 314 is accepted within the fifth receptacle, the fifth retainer may be engaged. Likewise, if the sixth round 315 is accepted within the sixth receptacle, the sixth retainer may be engaged.

In some embodiments, the first retainer may engage with the rim of the first round 310, the second retainer may engage with the rim of the second round 311, the third retainer may engage with the rim of the third round 312, the fourth retainer may engage with the rim of the fourth round 313, the fifth retainer may engage with the rim of the fifth round 314, and the sixth retainer may engage with the rim of the sixth round 315. In other embodiments, the retainers may engage with an extractor groove of a rimless round.

In some embodiments, each retainer may comprise a first retainment arm and a second retainment arm. The first retainment arm may be positioned opposite of the second retainment arm, such that, the first retainment arm and the second retainment arm may secure opposite sides of a round. Comparatively, in other embodiments, each retainer may comprise a substantially U-shaped arm, such that the two tops of the U may secure the round in place. Also comparatively, in other embodiments, a single retainment arm may be used to interface with the rim or extractor groove of a round. In addition, and for demonstration purposes only, if each receptacle is circular, then each receptacle may keep each round secured horizontally. This may allow the rounds to rest in their receptacles, without falling out of the side of the receptacle. Furthermore, if the round's respective retainer is engaged to the round, that may keep each round vertically secured. This may allow the rounds to rest in their receptacles, without falling out of the back or front of their receptacle.

In some embodiments, the first retainer and the second retainer may comprise the first button, the third retainer and the fourth retainer may comprise the second button, and the fifth retainer and the sixth retainer may comprise the third button. In other embodiments, each retainer may comprise its own individual button. Moreover, in other embodiments, there may be a single button that will correspond to all of the retainers. For demonstration purposes only, the first button may be configured to disengage the first retainer and the second retainer, the second button may be configured to disengage the third retainer and the fourth retainer, and the third button may be configured to disengage the fifth retainer and the sixth retainer. This may be explained as the disengagement of the first retainer, the disengagement of the second retainer, the disengagement of the third retainer, the disengagement of the fourth retainer, the disengagement of the fifth retainer, and the disengagement of the sixth retainer.

In some embodiments, the disengagement of the first retainer may release the first round 310 from the first receptacle, the disengagement of the second retainer may release the second round 311 from the second receptacle, the disengagement of the third retainer may release the third round 312 from the third receptacle, the disengagement of the fourth retainer may release the fourth round 313 from the fourth receptacle, the disengagement of the fifth retainer may release the fifth round 314 from the fifth receptacle, and the disengagement of the sixth retainer may release the sixth round 315 from the sixth receptacle.

In some embodiments, the first pivot point 316 may be rotatably engaged between the first segment 301 and the second segment 302. Similarly, the second pivot point 317 may be rotatably engaged between the second segment 302 and the third segment 303. By way of example, the first segment 301 may be rotated about the first pivot point 316, and the third segment 303 may be rotated about the second pivot point 317. In comparison, the second segment 302 may be rotated about the first pivot point 316 or the second pivot point 317. If the first segment 301, the second segment 302, and the third segment 303 are rotated, the first segment 301, the second segment 302, and the third segment 303 may be changed between the open configuration 341 and the closed configuration 342. Furthermore, the rotation of the first segment 301 and the third segment 303 may change the configuration of the first segment 301, the second segment 302, and the third segment 303 between the open configuration 341 and the closed configuration 342.

In some embodiments, the first actuator 327 may be in mechanical communication with the first segment 301 and the second segment 302. Similarly, the second actuator 328 may be in mechanical communication with the second segment 302 and the third segment 303. For demonstration purposes only, the first actuator 327 may be configured to rotate the first segment 301 and the second segment 302 about the first pivot point 316, and the second actuator 328 may be configured to rotate the second segment 302 and the third segment 303 about the second pivot point 317. Such that, the first segment 301, the second segment 302, and the third segment 303 may change configurations from the open configuration 341 to the closed configuration 342. In other embodiments, the first actuator 327 and the second actuator 328 may be configured to change the configuration of the first segment 301, the second segment 302, and the third segment 303 from the closed configuration 342 to the open configuration 341. In addition, in other embodiments, the first actuator 327 and the second actuator 328 may be configured to change the configuration of the first segment 301, the second segment 302, and the third segment 303 between the open configuration 341 and the closed configuration 342.

In some embodiments, the closed configuration 342 of the first segment 301, the second segment 302, and the third segment 303 may be configured to interface with a cylinder of a firearm. For example, the firearm may be a revolver. For illustrative purposes only, the first receptacle may align with a first chamber of the cylinder, the second receptacle may align with a second chamber of the cylinder, the third receptacle may align with a third chamber of the cylinder, the fourth receptacle may align with a fourth chamber of the cylinder, the fifth receptacle may align with a fifth chamber of the cylinder, and the sixth receptacle may align with a sixth chamber of the cylinder. Moreover, if the first round 310 has been loaded into the first receptacle, the second round 311 has been loaded into the second receptacle, the third round 312 has been loaded into the third receptacle, the fourth round 313 has been loaded into the fourth receptacle, the fifth round 314 has been loaded into the fifth receptacle, and the sixth round 315 has been loaded into the sixth receptacle. Also, if the closed configuration 342 of the first segment 301, the second segment 302, and the third segment 303 is aligned with the cylinder. And if the first button has disengaged the first retainer and the second retainer, the second button has disengaged the third retainer and the fourth retainer, and the third button has disengaged the fifth retainer and the sixth retainer. Then, the first round 310 may be loaded and retained within the first chamber of the cylinder, the second round 311 may be loaded and retained within the second chamber of the cylinder, the third round 312 may be loaded and retained within the third chamber of the cylinder, the fourth round 313 may be loaded and retained within the fourth chamber of the cylinder, the fifth round 314 may be loaded and retained within the fifth chamber of the cylinder, and the sixth round 315 may be loaded and retained within the sixth chamber of the cylinder. At this time, the firearm may be loaded and ready to be discharged.

In some embodiments, the open configuration 341 of the first segment 301, the second segment 302, and the third segment 303 may be configured to be substantially colinear. Furthermore, and solely for the purposes of demonstration, the open configuration 341 of the first segment 301, the second segment 302, and the third segment 303 may be configured to substantially rest inside a carrying case 343. In other embodiments, the open configuration 341 of the first segment 301, the second segment 302, and the third segment 303 may be configured to substantially rest within a pocket of an article of clothing.

In some embodiments, the first segment 301 may have a first angled edge; the second segment 302 may have a second angled edge and a third angled edge; and the third segment 303 may have a fourth angled edge. The first angled edge may be configured to interface with the second angled edge, and the third angled edge may be configured to interface with the fourth angled edge. This may allow the closed configuration 342 of the first segment 301, the second segment 302, and the third segment 303 to form a substantially circular structure, such that the receptacles of the segments align with the chambers of a cylinder of a firearm. In addition, the first segment 301 may further comprise a fifth angled edge, and the third segment 303 may further comprise a sixth angled edge. For example, the fifth angled edge may be configured to interface with the sixth angled edge in the closed configuration 342 of the first segment 301, the second segment 302, and the third segment 303.

Figure 4A:
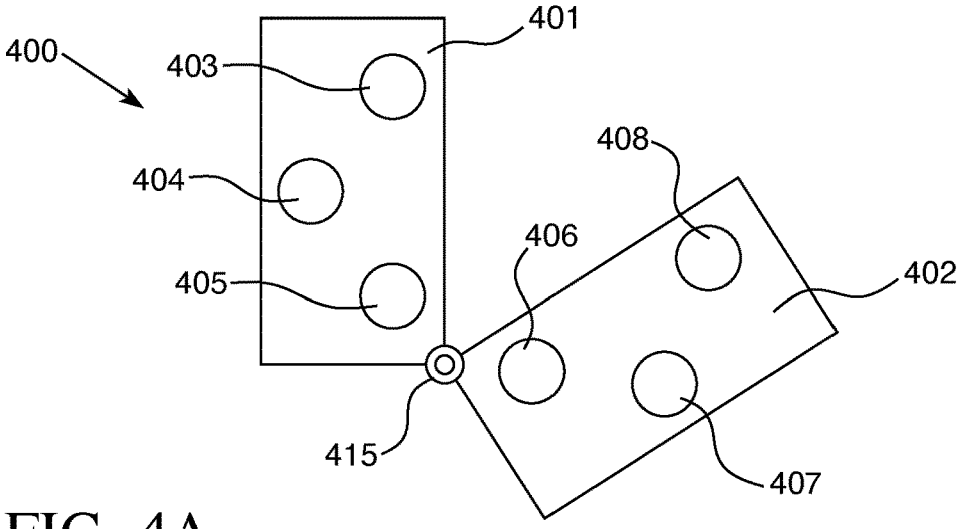
FIG. 4A depicts a front view of a fourth embodiment of a device for loading a firearm, according to aspects of the present disclosure.
Figure 4B:
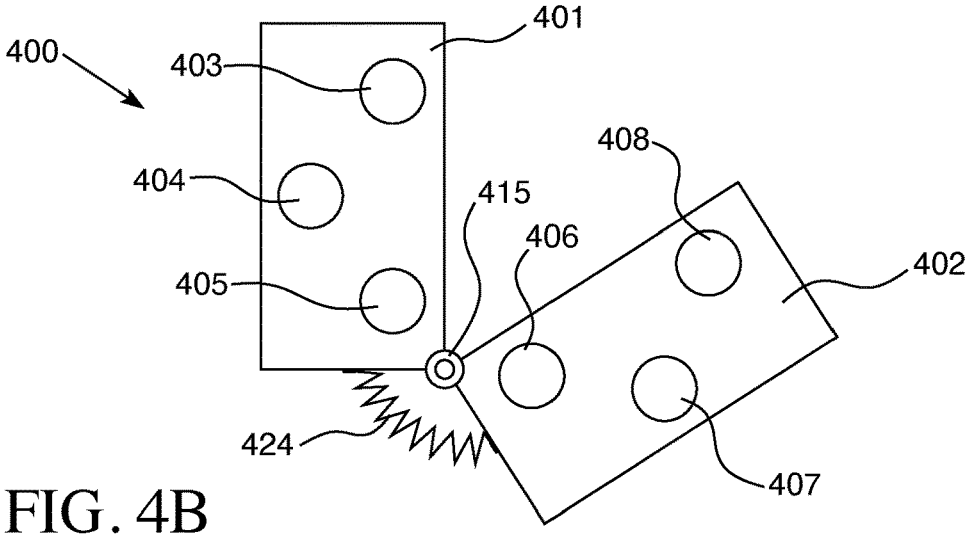
FIG. 4B depicts a front view of the fourth embodiment of the device with a spring actuator, according to aspects of the present disclosure.
Figure 4C:
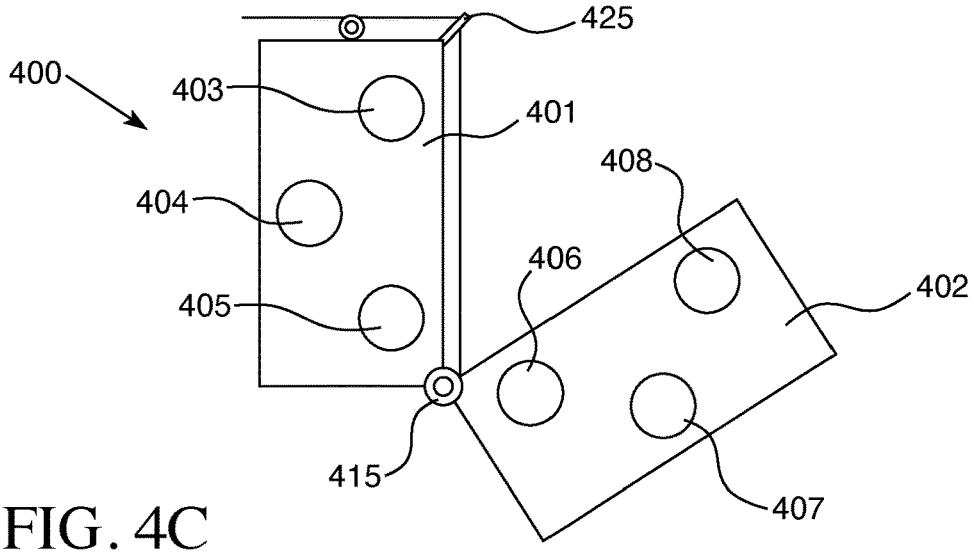
FIG. 4C depicts a front view of the fourth embodiment of the device with a pulley actuator, according to aspects of the present disclosure.
Figure 4D:
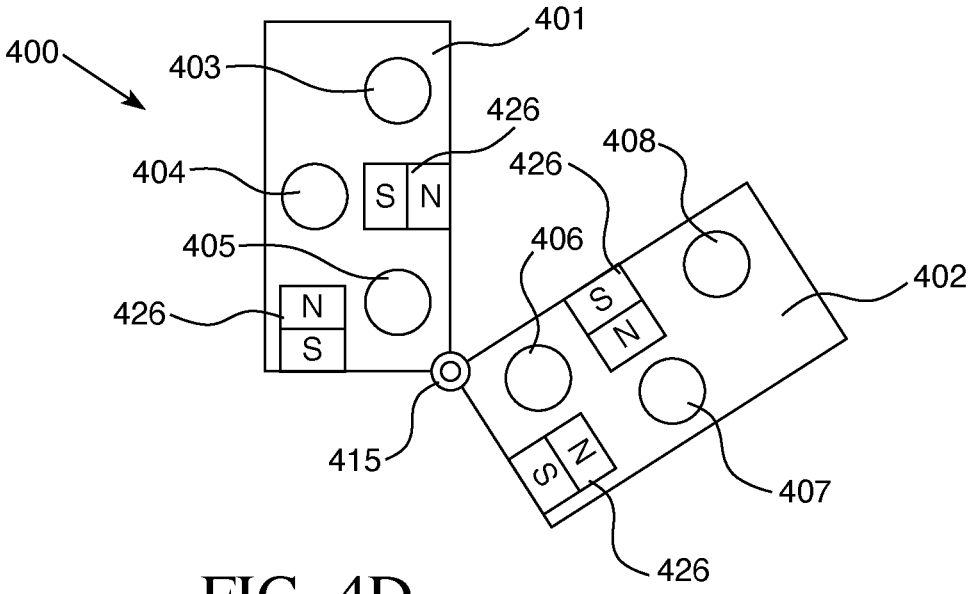
FIG. 4D depicts a front view of the fourth embodiment of the device with a magnet actuator, according to aspects of the present disclosure.
Figure 4E:
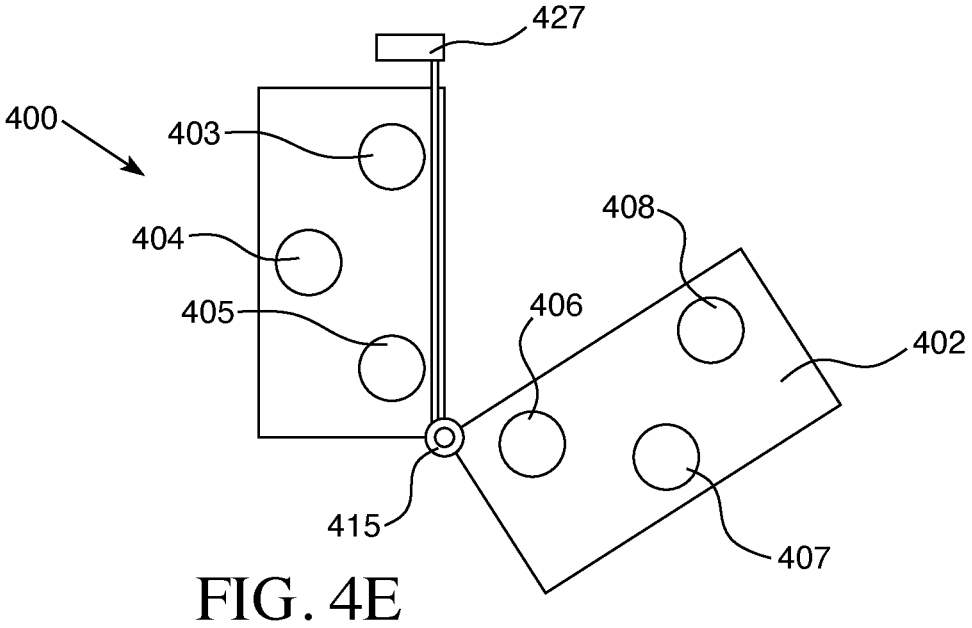
FIG. 4E depicts a front view of the fourth embodiment of the device with a push actuator, according to aspects of the present disclosure.

FIGS. 4A and 4E illustrate a fourth embodiment of a device. The device may include a body 400, a first segment 401, a second segment 402, a first receptacle 403, a second receptacle 404, a third receptacle 405, a fourth receptacle 406, a fifth receptacle 407, a sixth receptacle 408, a first pivot point 415, a first retainer (not shown), a second retainer (not shown), a third retainer (not shown), a fourth retainer (not shown), a fifth retainer (not shown), and a sixth retainer (not shown).

In some embodiments, the first segment 401 may comprise the first receptacle 403, the second receptacle 404, and the third receptacle 405; such that, the first receptacle 403 may be configured to accept a first round, the second receptacle 404 may be configured to accept a second round, and the third receptacle 405 may be configured to accept a third round. In addition, the second segment 402 may comprise the fourth receptacle 406, the fifth receptacle 407, and the sixth receptacle 408; such that, the fourth receptacle 406 may be configured to accept a fourth round, the fifth receptacle 407 may be configured to accept a fifth round, and the sixth receptacle 408 may be configured to accept a sixth round.

In some embodiments, the first receptacle 403 may be circular, such that the body of the first round may be encircled by the first receptacle 403. Moreover, the second receptacle 404 may be circular, such that the body of the second round may be encircled by the second receptacle 404. In addition, the third receptacle 405 may be circular, such that the body of the third round may be encircled by the third receptacle 405. Similarly, the fourth receptacle 406 may be circular, such that the body of the fourth round may be encircled by the fourth receptacle 406. Furthermore, the fifth receptacle 407 may be circular, such that the body of the fifth round may be encircled by the fifth receptacle 407. Likewise, the sixth receptacle 408 may be circular, such that the body of the sixth round may be encircled by the sixth receptacle 408.

In some embodiments, the first retainer may be in mechanical communication with the first receptacle 403, the second retainer may be in mechanical communication with the second receptacle 404, the third retainer may be in mechanical communication with the third receptacle 405, the fourth retainer may be in mechanical communication with the fourth receptacle 406, the fifth retainer may be in mechanical communication with the fifth receptacle 407, and the sixth retainer may be in mechanical communication with the sixth receptacle 408. If the first round is accepted within the first receptacle 403, the first retainer may be engaged. Similarly, if the second round is accepted within the second receptacle 404, the second retainer may be engaged. Moreover, if the third round is accepted within the third receptacle 405, the third retainer may be engaged. Furthermore, if the fourth round is accepted within the fourth receptacle 406, the fourth retainer may be engaged. In addition, if the fifth round is accepted within the fifth receptacle 407, the fifth retainer may be engaged. Likewise, if the sixth round is accepted within the sixth receptacle 408, the sixth retainer may be engaged.

In some embodiments, the first retainer may engage with the rim of the first round, the second retainer may engage with the rim of the second round, the third retainer may engage with the rim of the third round, the fourth retainer may engage with the rim of the fourth round, the fifth retainer may engage with the rim of the fifth round, and the sixth retainer may engage with the rim of the sixth round. In other embodiments, the retainers may engage with an extractor groove of a rimless round.

In some embodiments, each retainer may comprise a first retainment arm and a second retainment arm. The first retainment arm may be positioned opposite of the second retainment arm, such that, the first retainment arm and the second retainment arm may secure opposite sides of a round. Comparatively, in other embodiments, each retainer may comprise a substantially U-shaped arm, such that the two tops of the U may secure the round in place. In addition, and for demonstration purposes only, if each receptacle is circular, then each receptacle may keep each round secured horizontally. This may allow the rounds to rest in their receptacles, without falling out of the side of the receptacle. Furthermore, if the round's respective retainer is engaged to the round, that may keep each round vertically secured. This may allow the rounds to rest in their receptacles, without falling out of the back or front of their receptacle.

In some embodiments, the first retainer, the second retainer, and the third retainer may comprise the first button; the fourth retainer, the fifth retainer, and the sixth retainer may comprise the second button. In other embodiments, each retainer may comprise its own individual button. Moreover, in other embodiments, there may be a single button that will correspond to all of the retainers. For demonstration purposes only, the first button may be configured to disengage the first retainer, the second retainer, and third retainer; and the second button may be configured to disengage the fourth retainer, the fifth retainer, and the sixth retainer. This may be explained as the disengagement of the first retainer, the disengagement of the second retainer, the disengagement of the third retainer, the disengagement of the fourth retainer, the disengagement of the fifth retainer, and the disengagement of the sixth retainer.

In some embodiments, the disengagement of the first retainer may release the first round from the first receptacle 403, the disengagement of the second retainer may release the second round from the second receptacle 404, the disengagement of the third retainer may release the third round from the third receptacle 405, the disengagement of the fourth retainer may release the fourth round from the fourth receptacle 406, the disengagement of the fifth retainer may release the fifth round from the fifth receptacle 407, and the disengagement of the sixth retainer may release the sixth round from the sixth receptacle 408.

In some embodiments, the first pivot point 415 may be rotatably engaged between the first segment 401 and the second segment 402. By way of example, the first segment 401 and the second segment 402 may be rotated about the first pivot point 415. If the first segment 401 and the second segment 402 are rotated, the first segment 401 and the second segment 402 may be changed between the open configuration 440 and the closed configuration 441.

In some embodiments, a first actuator may be in mechanical communication with the first segment 401 and the second segment 402. For demonstration purposes only, the spring actuator may be configured to rotate the first segment 401 and the second segment 402 about the first pivot point 415. Such that, the first segment 401 and the second segment 402 may change configurations from the open configuration to the closed configuration. In other embodiments, the first actuator may be configured to change the configuration of the first segment 401 and the second segment 402 from the closed configuration to the open configuration. In addition, in other embodiments, the first actuator may be configured to change the configuration of the first segment 401 and the second segment 402 between the open configuration and the closed configuration.

In some embodiments, the first actuator may be comprised of a spring actuator 424, as shown in FIG. 4B. The spring actuator 424 may be comprised of an extension spring, such that the first segment 401 and the second segment 402 are pushed apart about the first pivot point 415. This may allow the first segment 401 and the second segment 402 to change configurations from the open configuration to the closed configuration. Conversely, the spring actuator 424 may be comprised of a compression spring, such that the first segment 401 and the second segment 402 are pulled together about the first pivot point 415. This may allow the first segment 401 and the second segment 402 to change configurations from the closed configuration to the open configuration.

In some embodiments, the first actuator may be comprised of a pulley actuator 425, as shown in FIG. 4C. The pulley actuator 425 may comprise a load-bearing end coupled to the second segment 402, such that the second segment 402 may be pulled towards the first segment 401. This may result in reconfiguring the first segment 401 and the second segment 402 from the open configuration to the closed configuration. Similarly, the pulley actuator 425 may comprise a load-bearing end coupled to the first segment 401, such that the first segment 401 may be pulled towards the second segment 402. This may result in reconfiguring the first segment 401 and the second segment 402 from the open configuration to the closed configuration.

In some embodiments, the first actuator may be comprised of a magnet actuator 426, as shown in FIG. 4D. The magnet actuator 426 may be configured to "snap" the first segment 401 and the second segment 402 between the open configuration and the closed configuration when actuated by a user. In this way, the magnetic actuator 426 may hold the first segment 401 and the second segment 402 in at least one of the open configuration and the closed configuration. Furthermore, the magnet actuator 426 may also be configured to "snap" the first segment 401 and the second segment 402 into at least one of the open configuration and the closed configuration. Such that, the first segment 401 and the second segment 402 may not need to be actuated by a user to "snap" into the closed configuration from the open configuration. Similarly, the first segment 401 and the second segment 402 may "snap" into the open configuration from the closed configuration.

In some embodiments, the first actuator may be comprised of a push actuator 427, as shown in FIG. 4E. The push actuator 427 may be configured to change the first segment 401 and the second segment 402 from the open configuration to the closed configuration. By way of example only, the push actuator 427 may have a push button defined on the first segment 401, and a push end that interfaces with the second segment 402. A user can actuate the push button, which may cause the push end to apply a force to the second segment, which may cause the second segment 402 to rotate about the first pivot point 415 into the closed configuration from the open configuration.

In some embodiments, the closed configuration 441 of the first segment 401 and the second segment 402 may be configured to interface with a cylinder of a firearm. For example, the firearm may be a revolver. For illustrative purposes only, the first receptacle 403 may align with a first chamber of the cylinder, the second receptacle 404 may align with a second chamber of the cylinder, the third receptacle 405 may align with a third chamber of the cylinder, the fourth receptacle 406 may align with a fourth chamber of the cylinder, the fifth receptacle 407 may align with a fifth chamber of the cylinder, and the sixth receptacle 408 may align with a sixth chamber of the cylinder. Moreover, if the first round has been loaded into the first receptacle 403, the second round has been loaded into the second receptacle 404, the third round has been loaded into the third receptacle 405, the fourth round has been loaded into the fourth receptacle 406, the fifth round has been loaded into the fifth receptacle 407, and the sixth round has been loaded into the sixth receptacle 408. Also, if the closed configuration 441 of the first segment 401 and the second segment 402 is aligned with the cylinder. And if the first button has disengaged the first retainer, the second retainer, and the third retainer; and the second button has disengaged the fourth retainer, the fifth retainer, and the sixth retainer. Then, the first round may be loaded and retained within the first chamber of the cylinder, the second round may be loaded and retained within the second chamber of the cylinder, the third round may be loaded and retained within the third chamber of the cylinder, the fourth round may be loaded and retained within the fourth chamber of the cylinder, the fifth round may be loaded and retained within the fifth chamber of the cylinder, and the sixth round may be loaded and retained within the sixth chamber of the cylinder. At this time, the firearm may be loaded and ready to be discharged.

In some embodiments, the open configuration 440 of the first segment 401 and the second segment 402 may be configured to be substantially colinear. Furthermore, and solely for the purposes of demonstration, the open configuration 440 of the first segment 401 and the second segment 402 may be configured to substantially rest inside a carrying case. In other embodiments, the open configuration 440 of the first segment 401 and the second segment 402 may be configured to substantially rest within a pocket of an article of clothing.

FIGS. 5A and 5B illustrate a fifth embodiment of a device. The device may include a body 500, a first segment 501, a second segment 502, a first receptacle 503, a second receptacle 504, a third receptacle 505, a fourth receptacle 506, a fifth receptacle 507, a sixth receptacle 508, a first pivot point 515, a first retainer 516, a second retainer 517, a third retainer 518, a fourth retainer 519, a fifth retainer 520, a sixth retainer 521, a first button 522, and a second button 523.

In some embodiments, the first segment 501 may comprise the first receptacle 503, the second receptacle 504, and the third receptacle 505; such that, the first receptacle 503 may be configured to accept a first round, the second receptacle 504 may be configured to accept a second round, and the third receptacle 505 may be configured to accept a third round. In addition, the second segment 502 may comprise the fourth receptacle 506, the fifth receptacle 507, and the sixth receptacle 508; such that, the fourth receptacle 506 may be configured to accept a fourth round, the fifth receptacle 507 may be configured to accept a fifth round, and the sixth receptacle 508 may be configured to accept a sixth round.

In some embodiments, the first receptacle 503 may be circular, such that the body of the first round may be encircled by the first receptacle 503. Moreover, the second receptacle 504 may be circular, such that the body of the second round may be encircled by the second receptacle 504. In addition, the third receptacle 505 may be circular, such that the body of the third round may be encircled by the third receptacle 505. Similarly, the fourth receptacle 506 may be circular, such that the body of the fourth round may be encircled by the fourth receptacle 506. Furthermore, the fifth receptacle 507 may be circular, such that the body of the fifth round may be encircled by the fifth receptacle 507. Likewise, the sixth receptacle 508 may be circular, such that the body of the sixth round may be encircled by the sixth receptacle 508.

In some embodiments, the first retainer 516 may be in mechanical communication with the first receptacle 503, the second retainer 517 may be in mechanical communication with the second receptacle 504, the third retainer 518 may be in mechanical communication with the third receptacle 505, the fourth retainer 519 may be in mechanical communication with the fourth receptacle 506, the fifth retainer 520 may be in mechanical communication with the fifth receptacle 507, and the sixth retainer 521 may be in mechanical communication with the sixth receptacle 508. If the first round is accepted within the first receptacle 503, the first retainer 516 may be engaged 528. Similarly, if the second round is accepted within the second receptacle 504, the second retainer 517 may be engaged 529. Moreover, if the third round is accepted within the third receptacle 505, the third retainer 518 may be engaged 530. Furthermore, if the fourth round is accepted within the fourth receptacle 506, the fourth retainer 519 may be engaged 531. In addition, if the fifth round is accepted within the fifth receptacle 507, the fifth retainer 520 may be engaged 532. Likewise, if the sixth round is accepted within the sixth receptacle 508, the sixth retainer 521 may be engaged 533.

In some embodiments, the first retainer 516 may engage with the rim of the first round, the second retainer 517 may engage with the rim of the second round, the third retainer 518 may engage with the rim of the third round, the fourth retainer 519 may engage with the rim of the fourth round, the fifth retainer 520 may engage with the rim of the fifth round, and the sixth retainer 521 may engage with the rim of the sixth round. In other embodiments, the retainers may engage with an extractor groove of a rimless round.

In some embodiments, each retainer may comprise a first retainment arm and a second retainment arm. The first retainment arm may be positioned opposite of the second retainment arm, such that, the first retainment arm and the second retainment arm may secure opposite sides of a round. Comparatively, in other embodiments, each retainer may comprise a substantially U-shaped arm, such that the two tops of the U may secure the round in place. In addition, and for demonstration purposes only, if each receptacle is circular, then each receptacle may keep each round secured horizontally. This may allow the rounds to rest in their receptacles, without falling out of the side of the receptacle. Furthermore, if the round's respective retainer is engaged to the round, that may keep each round vertically secured. This may allow the rounds to rest in their receptacles, without falling out of the back or front of their receptacle.

In some embodiments, the first retainer 516, the second retainer 517, and the third retainer 518 may comprise the first button 522; the fourth retainer 519, the fifth retainer 520, and the sixth retainer 521 may comprise the second button 523. In other embodiments, each retainer may comprise its own individual button. Moreover, in other embodiments, there may be a single button that will correspond to all of the retainers. For demonstration purposes only, the first button 522 may be configured to disengage the first retainer 516, the second retainer 517, and third retainer 518; and the second button 523 may be configured to disengage the fourth retainer 519, the fifth retainer 520, and the sixth retainer 521. This is shown in FIG. 5B as the disengagement of the first retainer 534, the disengagement of the second retainer 535, the disengagement of the third retainer 536, the disengagement of the fourth retainer 537, the disengagement of the fifth retainer 538, and the disengagement of the sixth retainer 539.

In some embodiments, the disengagement of the first retainer 534 may release the first round from the first receptacle 503, the disengagement of the second retainer 535 may release the second round from the second receptacle 504, the disengagement of the third retainer 536 may release the third round from the third receptacle 505, the disengagement of the fourth retainer 537 may release the fourth round from the fourth receptacle 506, the disengagement of the fifth retainer 538 may release the fifth round from the fifth receptacle 507, and the disengagement of the sixth retainer 539 may release the sixth round from the sixth receptacle 508.

In some embodiments, the first pivot point 515 may be rotatably engaged between the first segment 501 and the second segment 502. By way of example, the first segment 501 and the second segment 502 may be rotated about the first pivot point 515. If the first segment 501 and the second segment 502 are rotated, the first segment 501 and the second segment 502 may be changed between the open configuration 540 and the closed configuration 541.

In some embodiments, the closed configuration 541 of the first segment 501 and the second segment 502 may be configured to interface with a cylinder of a firearm. For example, the firearm may be a revolver. For illustrative purposes only, the first receptacle 503 may align with a first chamber of the cylinder, the second receptacle 504 may align with a second chamber of the cylinder, the third receptacle 505 may align with a third chamber of the cylinder, the fourth receptacle 506 may align with a fourth chamber of the cylinder, the fifth receptacle 507 may align with a fifth chamber of the cylinder, and the sixth receptacle 508 may align with a sixth chamber of the cylinder. Moreover, if the first round has been loaded into the first receptacle 503, the second round has been loaded into the second receptacle 504, the third round has been loaded into the third receptacle 505, the fourth round has been loaded into the fourth receptacle 506, the fifth round has been loaded into the fifth receptacle 507, and the sixth round has been loaded into the sixth receptacle 508. Also, if the closed configuration 541 of the first segment 501 and the second segment 502 is aligned with the cylinder. And if the first button 522 has disengaged the first retainer 534, the second retainer 535, and the third retainer 536; and the second button 523 has disengaged the fourth retainer 537, the fifth retainer 538, and the sixth retainer 539. Then, the first round may be loaded and retained within the first chamber of the cylinder, the second round may be loaded and retained within the second chamber of the cylinder, the third round may be loaded and retained within the third chamber of the cylinder, the fourth round may be loaded and retained within the fourth chamber of the cylinder, the fifth round may be loaded and retained within the fifth chamber of the cylinder, and the sixth round may be loaded and retained within the sixth chamber of the cylinder. At this time, the firearm may be loaded and ready to be discharged.

In some embodiments, the open configuration 540 of the first segment 501 and the second segment 502 may be configured to be substantially colinear. Furthermore, and solely for the purposes of demonstration, the open configuration 540 of the first segment 501 and the second segment 502 may be configured to substantially rest inside a carrying case. In other embodiments, the open configuration 540 of the first segment 501 and the second segment 502 may be configured to substantially rest within a pocket of an article of clothing.

FIGS. 6A and 6B illustrate a sixth embodiment of a device. The device may include a body 600, a first segment 601, a second segment 602, a first receptacle (not shown), a second receptacle (not shown), a third receptacle (not shown), a fourth receptacle (not shown), a fifth receptacle (not shown), a sixth receptacle (not shown), a first pivot point 615, a first retainer (not shown), a second retainer (not shown), a third retainer (not shown), a fourth retainer (not shown), a fifth retainer (not shown), and a sixth retainer (not shown).

In some embodiments, the first segment 601 may comprise the first receptacle, the second receptacle, and the third receptacle; such that, the first receptacle may be configured to accept a first round 609, the second receptacle may be configured to accept a second round 610, and the third receptacle may be configured to accept a third round 611. In addition, the second segment 602 may comprise the fourth receptacle, the fifth receptacle, and the sixth receptacle; such that, the fourth receptacle may be configured to accept a fourth round 612, the fifth receptacle may be configured to accept a fifth round 613, and the sixth receptacle may be configured to accept a sixth round 614.

In some embodiments, the first receptacle may be circular, such that the body of the first round 609 may be encircled by the first receptacle. Moreover, the second receptacle may be circular, such that the body of the second round 610 may be encircled by the second receptacle. In addition, the third receptacle may be circular, such that the body of the third round 611 may be encircled by the third receptacle. Similarly, the fourth receptacle may be circular, such that the body of the fourth round 612 may be encircled by the fourth receptacle. Furthermore, the fifth receptacle may be circular, such that the body of the fifth round 613 may be encircled by the fifth receptacle. Likewise, the sixth receptacle may be circular, such that the body of the sixth round 614 may be encircled by the sixth receptacle.

In some embodiments, the first retainer may be in mechanical communication with the first receptacle, the second retainer may be in mechanical communication with the second receptacle, the third retainer may be in mechanical communication with the third receptacle, the fourth retainer may be in mechanical communication with the fourth receptacle, the fifth retainer may be in mechanical communication with the fifth receptacle, and the sixth retainer may be in mechanical communication with the sixth receptacle. If the first round 609 is accepted within the first receptacle, the first retainer may be engaged. Similarly, if the second round 610 is accepted within the second receptacle, the second retainer may be engaged. Moreover, if the third round 611 is accepted within the third receptacle, the third retainer may be engaged. Furthermore, if the fourth round 612 is accepted within the fourth receptacle, the fourth retainer may be engaged. In addition, if the fifth round 613 is accepted within the fifth receptacle, the fifth retainer may be engaged. Likewise, if the sixth round 614 is accepted within the sixth receptacle, the sixth retainer may be engaged.

In some embodiments, the first retainer may engage with the rim of the first round 609, the second retainer may engage with the rim of the second round 610, the third retainer may engage with the rim of the third round 611, the fourth retainer may engage with the rim of the fourth round 612, the fifth retainer may engage with the rim of the fifth round 613, and the sixth retainer may engage with the rim of the sixth round 614. In other embodiments, the retainers may engage with an extractor groove of a rimless round.

In some embodiments, each retainer may comprise a first retainment arm and a second retainment arm. The first retainment arm may be positioned opposite of the second retainment arm, such that, the first retainment arm and the second retainment arm may secure opposite sides of a round. Comparatively, in other embodiments, each retainer may comprise a substantially U-shaped arm, such that the two tops of the U may secure the round in place. In addition, and for demonstration purposes only, if each receptacle is circular, then each receptacle may keep each round secured horizontally. This may allow the rounds to rest in their receptacles, without falling out of the side of the receptacle. Furthermore, if the round's respective retainer is engaged to the round, that may keep each round vertically secured. This may allow the rounds to rest in their receptacles, without falling out of the back or front of their receptacle.

In some embodiments, the first retainer, the second retainer, and the third retainer may comprise the first button; the fourth retainer, the fifth retainer, and the sixth retainer may comprise the second button. In other embodiments, each retainer may comprise its own individual button. Moreover, in other embodiments, there may be a single button that will correspond to all of the retainers. For demonstration purposes only, the first button may be configured to disengage the first retainer, the second retainer, and third retainer; and the second button may be configured to disengage the fourth retainer, the fifth retainer, and the sixth retainer. This may be explained as the disengagement of the first retainer, the disengagement of the second retainer, the disengagement of the third retainer, the disengagement of the fourth retainer, the disengagement of the fifth retainer, and the disengagement of the sixth retainer.

In some embodiments, the disengagement of the first retainer may release the first round 609 from the first receptacle, the disengagement of the second retainer may release the second round 610 from the second receptacle, the disengagement of the third retainer may release the third round 611 from the third receptacle, the disengagement of the fourth retainer may release the fourth round 612 from the fourth receptacle, the disengagement of the fifth retainer may release the fifth round 613 from the fifth receptacle, and the disengagement of the sixth retainer may release the sixth round 614 from the sixth receptacle.

In some embodiments, the first pivot point 615 may be rotatably engaged between the first segment 601 and the second segment 602. By way of example, the first segment 601 and the second segment 602 may be rotated about the first pivot point 615. If the first segment 601 and the second segment 602 are rotated, the first segment 601 and the second segment 602 may be changed between the open configuration 640 and the closed configuration 641.

In some embodiments, the closed configuration 641 of the first segment 601 and the second segment 602 may be configured to interface with a cylinder of a firearm. For example, the firearm may be a revolver. For illustrative purposes only, the first receptacle may align with a first chamber of the cylinder, the second receptacle may align with a second chamber of the cylinder, the third receptacle may align with a third chamber of the cylinder, the fourth receptacle may align with a fourth chamber of the cylinder, the fifth receptacle may align with a fifth chamber of the cylinder, and the sixth receptacle may align with a sixth chamber of the cylinder. Moreover, if the first round 609 has been loaded into the first receptacle, the second round 610 has been loaded into the second receptacle, the third round 611 has been loaded into the third receptacle, the fourth round 612 has been loaded into the fourth receptacle, the fifth round 613 has been loaded into the fifth receptacle, and the sixth round 614 has been loaded into the sixth receptacle. Also, if the closed configuration 641 of the first segment 601 and the second segment 602 is aligned with the cylinder. And if the first button has disengaged the first retainer, the second retainer, and the third retainer; the second button has disengaged the fourth retainer, the fifth retainer, and the sixth retainer. Then, the first round 609 may be loaded and retained within the first chamber of the cylinder, the second round 610 may be loaded and retained within the second chamber of the cylinder, the third round 611 may be loaded and retained within the third chamber of the cylinder, the fourth round 612 may be loaded and retained within the fourth chamber of the cylinder, the fifth round 613 may be loaded and retained within the fifth chamber of the cylinder, and the sixth round 614 may be loaded and retained within the sixth chamber of the cylinder. At this time, the firearm may be loaded and ready to be discharged.

In some embodiments, the open configuration 640 of the first segment 601 and the second segment 602 may be configured to be substantially colinear. Furthermore, and solely for the purposes of demonstration, the open configuration 640 of the first segment 601 and the second segment 602 may be configured to substantially rest inside a carrying case. In other embodiments, the open configuration 640 of the first segment 601 and the second segment 602 may be configured to substantially rest within a pocket of an article of clothing.

FIGS. 7A through 7D illustrate a seventh embodiment of a device. The device may include a first receptacle 700, a spring retainer 702, and a latch retainer 703. By way of example only, the first receptacle may be configured to accept a first round 701.

Figure 7A:
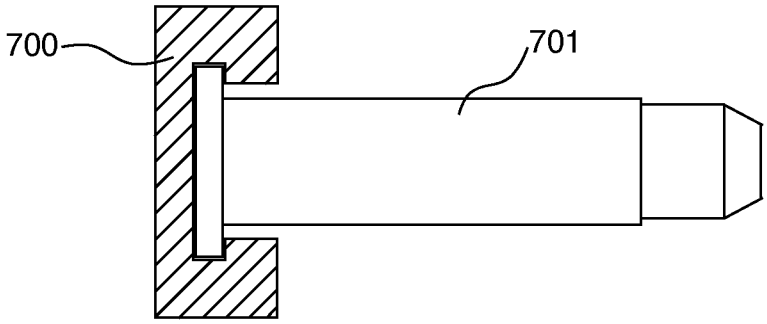
FIG. 7A depicts a side view of a seventh embodiment of a device for loading a firearm, according to aspects of the present disclosure.

In some embodiments, the first receptacle 700 may be comprised of a substantially flexible material, as shown in FIG. 7A. The first receptacle 700 may be configured to accept a first round 701 for use in a firearm. The first receptacle 700 may be configured to wrap around the rim of the first round 701, such that the first round 701 is secured within the first receptacle 700. For illustrative purposes, the first receptacle 700 may stretch around the rim of the first round 701. In other embodiments, the first receptacle 700 may stretch into and interface with an extractor groove of a round.

Figure 7B:
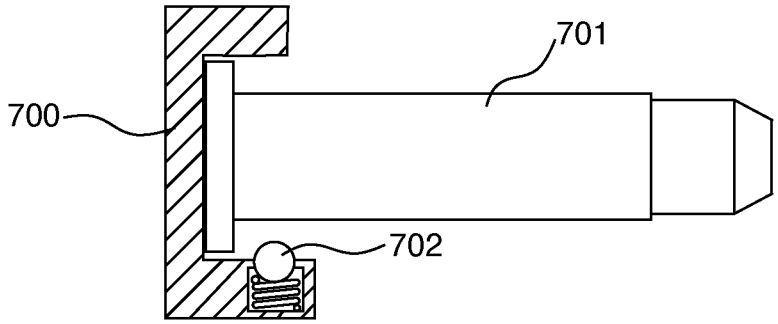
FIG. 7B depicts a side view of the seventh embodiment of the device with a spring retainer, according to aspects of the present disclosure.

In some embodiments, the first receptacle 700 may be engaged with a spring retainer 702, as shown in FIG. 7B. If a first round 701 is inserted into the first receptacle 700, the spring retainer 702 may be configured to move out of the way of the rim. Then, the spring retainer 702 may be configured to go back to its original position, such that the spring retainer 702 secures the first round 701 within the first receptacle 700 by interfacing with the rim of the first round 701. In other embodiments, the spring retainer 702 may secure the first round 701 within the first receptacle 700 by interfacing with an extractor groove. If the first round 701 is secured within the first receptacle 700, then a user may release the spring retainer 702 to release the first round 701 from the first receptacle 700.

Figure 7C:
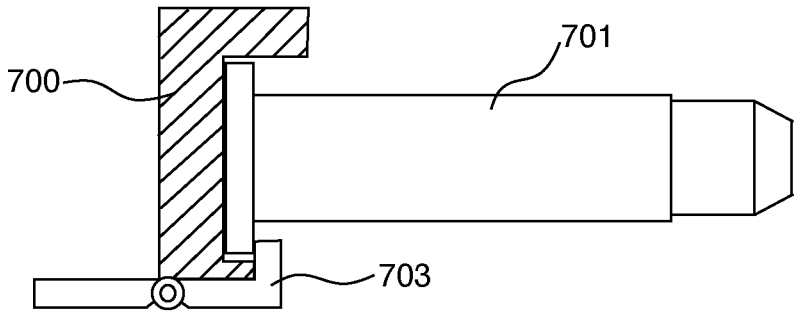
FIG. 7C depicts a side view of the seventh embodiment of the device with a latch retainer, according to aspects of the present disclosure.
Figure 7D:
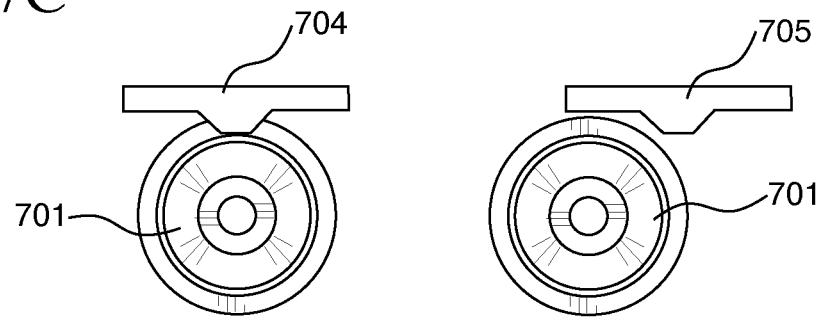
FIG. 7D depicts a close-up view of the seventh embodiment of the device comparing the engagement and disengagement of the retainer, according to aspects of the present disclosure.

In some embodiments, the first receptacle 700 may be engaged with a latch retainer 703, as shown in FIG. 7C. If a first round 701 is inserted into the first receptacle 700, then the latch retainer 703 may be moved into place and interfaced with the rim of the first round 701 to secure the first round 701 within the first receptacle. In other embodiments, the latch retainer 703 may be interfaced with an extractor groove of a round to secure the round within the first receptacle 700. A user may disengage the latch retainer 703 to release the first round 701 from the first receptacle 700.

In some embodiments, a retainer arm may be used to secure a first round 701 within a receptacle. There may be at least one retainer arm that interfaces with a rim of the first round 701, to secure the first round 701 within a receptacle. In other embodiments, at least one retainer arm may interface with an extractor groove of a round, to secure the round within a receptacle. In other embodiments, there may be a first retainer arm and a second retainer arm. The first retainer arm may engage a first side of a round, such that the second retainer arm may engage with a second side of a round. By way of example only, the first retainer arm and the second retainer arm may interface with a rim of a round. In other embodiments, the first retainer arm and the second retainer arm may interface with an extractor groove of a round.

Some embodiments of the devices may be able to be utilized by a user with a single hand to load a firearm. Moreover, the device may be able to be utilized by a user with two hands, when loading rounds into the device.

Prior inventions of speed loaders have utilized a circular to linear transformation design, such that store the speed loader is carried while linear and used to load a revolver while circular. These prior inventions have had problems with retaining the rounds in the speed loader while changing from the linear to circular configurations. In addition, prior inventions have had problems properly aligning the rounds in the speed loader to the chambers in a cylinder of a firearm. Embodiments of the present invention have addressed these problems through several aspects. The receptacles in the present invention may allow the round to be secured on all sides. In addition, the retainers may allow the round to be secured vertically (from moving in and out) of the receptacles. These aspects allow the rounds to stay secured within their receptacles while the device change between the open and closed configuration. Furthermore, the segments are shaped with angled edges, which may allow the segments to form a circular shape of the rounds while in the closed configuration. This may correspond to the chambers in the cylinder of a firearm, which may allow all of the rounds to be loaded into the firearm at one time.

Some embodiments of the devices may comprise a body defining a single segment, two segments, three segments, four segments, five segments, six segments, seven segments, eight segments, nine segments, ten segments, eleven segments, twelve segments, thirteen segments, fourteen segments, fifteen segments, sixteen segments, seventeen segments, eighteen segments, nineteen segments, and twenty segments. Furthermore, each segment may comprise a single receptacle, two receptacles, three receptacles, four receptacles, five receptacles, six receptacles, seven receptacles, eight receptacles, nine receptacles, and ten receptacles.

I claim:

1. A device for loading a firearm, the device comprising:

a body defining a first segment, a second segment, and a third segment, wherein the first segment comprises a first receptacle and a second receptacle, the second segment comprises a third receptacle and a fourth receptacle, and the third segment comprises a fifth receptacle and a sixth receptacle, wherein the first receptacle is configured to accept a first round for use in the firearm, the second receptacle is configured to accept a second round for use in the firearm, the third receptacle is configured to accept a third round for use in the firearm, the fourth receptacle is configured to accept a fourth round for use in the firearm, the fifth receptacle is configured to accept a fifth round for use in the firearm, and the sixth receptacle is configured to accept a sixth round for use in the firearm;

a first pivot point engaged between the first segment and the second segment;

a second pivot point engaged between the second segment and the third segment;

a first retainer in mechanical communication with the first receptacle;

a second retainer in mechanical communication with the second receptacle;

a third retainer in mechanical communication with the third receptacle;

a fourth retainer in mechanical communication with the fourth receptacle;

a fifth retainer in mechanical communication with the fifth receptacle; and a sixth retainer in mechanical communication with the sixth receptacle, wherein the first retainer is engaged when the first round is secured, the second retainer is engaged when the second round is secured, the third retainer is engaged when the third round is secured, the fourth retainer is engaged when the fourth round is secured, the fifth retainer is engaged when the fifth round is secured, and the sixth retainer is engaged when the sixth round is secured, wherein the first retainer and the second retainer comprise a first button, the third retainer and the fourth retainer comprise a second button, and the fifth retainer and the sixth retainer comprise a third button, wherein the first button is configured to disengage the first retainer and the second retainer, the second button is configured to disengage the third retainer and the fourth retainer, and the third button is configured to disengage the fifth retainer and the sixth retainer.

2. The device of claim 1, wherein the first retainer is configured to release the first round when disengaged, the second retainer is configured to release the second round when disengaged, the third retainer is configured to release the third round when disengaged, the fourth retainer is configured to release the fourth round when disengaged, the fifth retainer is configured to release the fifth round when disengaged, and the sixth retainer is configured to release the sixth round when disengaged.

3. The device of claim 1, wherein the first segment, the second segment, and the third segment are in an open configuration.

4. The device of claim 3, wherein the open configuration of the first segment, the second segment, and the third segment is configured to be substantially colinear.

5. The device of claim 3, wherein the body further comprises a first actuator and a second actuator, wherein the first actuator is in mechanical communication with the first segment and the second segment, and the second actuator is in mechanical communication with the second segment and the third segment.

6. The device of claim 5, wherein the first actuator and the second actuator are configured to change the first segment, the second segment, and the third segment between the open configuration and a closed configuration.

7. The device of claim 6, wherein the closed configuration of the first segment, the second segment, and the third segment is configured to interface with a cylinder of the firearm.

8. A method for loading a firearm utilizing a device, the method comprising:

loading a first round into a first receptacle and a second round into a second receptacle, wherein the first receptacle and the second receptacle are defined on a first segment, loading a third round into a third receptacle and a fourth round into a fourth receptacle, wherein the third receptacle and the fourth receptacle are defined on a second segment, loading a fifth round into a fifth receptacle and a sixth round into a sixth receptacle, wherein the fifth receptacle and the sixth receptacle are defined on a third segment, wherein a first pivot point engages between the first segment and the second segment, and a second pivot point engages between the second segment and the third segment;

rotating the first segment about the first pivot point, the second segment about at least one of the first pivot point and the second pivot point, and the third segment about the second pivot point such that the first segment, the second segment, and the third segment are reconfigured between an open configuration and a closed configuration;

interfacing the closed configuration of the first segment, the second segment, and the third segment with a cylinder of the firearm by aligning the first round to a first chamber of the cylinder, the second round to a second chamber of the cylinder, the third round to a third chamber of the cylinder, the fourth round to a fourth chamber of the cylinder, the fifth round to a fifth chamber of the cylinder, and the sixth round to a sixth chamber of the cylinder;

engaging a first retainer to secure the first round substantially within the first receptacle, engaging a second retainer to secure the second round substantially within the second receptacle, and engaging a third retainer to secure the third round substantially within the third receptacle;

disengaging the first retainer to release the first round from the first receptacle, disengaging the second retainer to release the second round from the second receptacle, and disengaging the third retainer to release the third round from the third receptacle; and a actuating a first button to disengage the first retainer and actuating a second button to a disengage the third.

9. The method of claim 8, wherein the open configuration of the first segment, the second segment, and the third segment is configured to be substantially colinear.

10. The method of claim 8 further comprising engaging a first actuator and a second actuator, wherein the first actuator is configured to rotate the first segment and the second segment about the first pivot point, and the second actuator is configured to rotate the second segment and the third segment about the second pivot point.

11. The method of claim 8 further comprising retaining the first round, the second round, the third round, the fourth round, the fifth round, and the sixth round substantially within the cylinder of the firearm.

* * * * *